US011104500B2

(12) United States Patent
Wetsch

(10) Patent No.: US 11,104,500 B2
(45) Date of Patent: Aug. 31, 2021

(54) SHAPED INFLATABLE SHOE INSERT

(71) Applicant: PREGIS INNOVATIVE PACKAGING LLC, Deerfield, IL (US)

(72) Inventor: Thomas D. Wetsch, St. Charles, IL (US)

(73) Assignee: Pregis Innovative Packaging LLC, Deerfield, IL (US)

( * ) Notice: Subject to any disclaimer, the term of this patent is extended or adjusted under 35 U.S.C. 154(b) by 0 days.

(21) Appl. No.: 16/104,024

(22) Filed: Aug. 16, 2018

(65) Prior Publication Data

US 2019/0055076 A1 Feb. 21, 2019

Related U.S. Application Data

(60) Provisional application No. 62/546,447, filed on Aug. 16, 2017.

(51) Int. Cl.

| | |
|---|---|
| ***A43D 3/14*** | (2006.01) |
| ***B65D 81/05*** | (2006.01) |
| ***A43D 3/04*** | (2006.01) |
| ***B65D 85/18*** | (2006.01) |

(52) U.S. Cl.

CPC ..... *B65D 81/052* (2013.01); *A43D 3/04* (2013.01); *A43D 3/14* (2013.01); *A43D 3/1433* (2013.01); *B65D 85/187* (2013.01)

(58) Field of Classification Search

CPC ..... A43D 3/04; A43D 3/14; A43D 3/1416; A43D 3/1425; A43D 3/1433

See application file for complete search history.

(56) References Cited

U.S. PATENT DOCUMENTS

| | | | | |
|---|---|---|---|---|
| 1,086,782 A * | 2/1914 | Moore | ..... | A43D 3/04 12/114.4 |
| 1,493,605 A * | 5/1924 | Comstock | ..... | A43D 3/04 12/114.4 |
| 4,400,840 A | 8/1983 | Sly | | |

(Continued)

FOREIGN PATENT DOCUMENTS

| | | |
|---|---|---|
| CN | 1769145 A | 5/2006 |
| CN | 201813961 U | 5/2011 |

(Continued)

OTHER PUBLICATIONS

International Application No. PCT/IB2018/056206, filed Aug. 16, 2018, International Search Report and Written Opinion dated Dec. 17, 2018.

*Primary Examiner* — Ted Kavanaugh
(74) *Attorney, Agent, or Firm* — Fox Rothschild LLP

(57) ABSTRACT

An inflatable shoe insert assembly may have an elongated lower element formed of opposing, flexible, polymeric plies that are sealed together to define a tubular inflation chamber that is narrow and elongated and is configured to seal inflation fluid therein; a shoe-upper element formed of opposing, flexible, polymeric plies that are sealed together to define a shoe-upper inflation chamber configured to seal inflation fluid therein; wherein lower and upper inflation chambers are configured and dimensioned to fit together into a shoe and support each other in an installed position to cooperatively support and maintain the shape of the shoe upper.

21 Claims, 16 Drawing Sheets

(56) References Cited

U.S. PATENT DOCUMENTS

| | | | | |
|---|---|---|---|---|
| 5,341,532 | A * | 8/1994 | Markowitz | A43D 3/04 12/114.4 |
| 6,971,135 | B2 | 12/2005 | Nadler | |
| 7,926,507 | B2 | 4/2011 | Wetsch | |
| 8,061,110 | B2 | 11/2011 | Wetsch | |
| 8,128,770 | B2 | 3/2012 | Wetsch | |
| 2005/0241081 | A1 * | 11/2005 | Nadler | A43D 3/145 12/114.4 |
| 2011/0172072 | A1 | 7/2011 | Wetsch | |
| 2014/0261752 | A1 | 9/2014 | Wetsch | |
| 2015/0033669 | A1 | 2/2015 | Dobreski | |
| 2015/0291336 | A1 * | 10/2015 | Wetsch | B32B 27/32 428/43 |
| 2017/0071292 | A1 | 3/2017 | Wetsch | |
| 2019/0069642 | A1 * | 3/2019 | Hughes | A43D 3/1433 |

FOREIGN PATENT DOCUMENTS

| | | | |
|---|---|---|---|
| CN | 207041074 | U | 2/2018 |
| DE | 2443859 | A1 | 3/1976 |
| DE | 3805721 | A1 | 12/1988 |
| JP | H07165266 | A | 6/1995 |
| WO | 9008487 | A1 | 8/1990 |

* cited by examiner

SHAPED INFLATABLE SHOE INSERT

CROSS REFERENCE TO RELATED APPLICATIONS

The present application claims priority to U.S. provisional application No. 62/546,447 filed Aug. 16, 2017 entitled "Shaped Inflatable Shoe Insert," the disclosure of which is hereby incorporated by reference in its entirety.

TECHNICAL FIELD

The present disclosure relates to packaging materials. More particularly, the present disclosure is directed to devices and methods for manufacturing inflatable cushions to be used as packaging material.

BACKGROUND

Shoes are produced and typically shipped in paperboard cartons for transportation and sale. Typically, to protect the shoes from being crushed or damaged during transportation and prior to sale, many producers insert paper wadding, molded pulp shapes, or other combinations of materials to maintain the form factor of the shoe. If the shoes are not filled, then during long shipping cycles the shoes will take or form memory in various shapes that will not meet the consumer esthetics when they try on the shoes. The use of molded pulp or crumpled paper not only is used as filler to retain the shape but it has no memory and can be crushed during transportation and storage. These materials also do not have the consumer appeal and marketing that shoe company's desire. They also carry extra weight and cost when used as filler. Recently, alternatives have come to maker such as blow molded shapes made to try and fill out the cavity of the shoe to maintain the shape, but they do not have the ability to cove a range of sizes without individual forms being made.

A variety of inflated cushions are known and used for sundry packaging applications. For example, inflated cushions are often used as void-fill packaging in a manner similar to or in place of foam peanuts, crumpled paper, and similar products. Also for example, inflated cushions are often used as protective packaging in place of molded or extruded packaging components. Generally, inflated cushions are formed from films having two plies that are joined together by seals. The seals can be formed simultaneously with inflation, so as to capture air therein, or prior to inflation to define a film configuration having inflatable chambers. The inflatable chambers can be inflated with air or another gas and thereafter sealed to inhibit or prevent the release of the air or gas.

SUMMARY

In an example, an inflatable shoe insert assembly may have an elongated tubular element formed of opposing, flexible, polymeric plies that are sealed together to define a tubular inflation chamber that is narrow and elongated and is configured to seal inflation fluid therein; a shoe-upper element formed of opposing, flexible, polymeric plies that are sealed together to define a shoe-upper inflation chamber configured to seal inflation fluid therein; wherein tubular and shoe upper inflation chambers are configured and dimensioned to fit together into a shoe and support each other in an installed position to cooperatively support and maintain the shape of the shoe upper.

DETAILED DESCRIPTION

The present disclosure is related to inflated packaging elements, such as shoe-packaging inserts for preserving the shape of a shoe and reducing deforming during shipping. Illustrative embodiments will now be described to provide an overall understanding of the disclosed apparatus. Those of ordinary skill in the art will understand that the disclosed apparatus may be adapted and modified to provide alternative embodiments of the apparatus for other applications, and that other addition s and modifications may be made to the disclosed apparatus without departing from the scope of the present disclosure. For example, features of the illustrative embodiments may be combined, separated, interchanged and/or re-arranged to generate other embodiments. The embodiments shown can be used for a variety of inflated packaging elements, such as shoe inserts. A person of ordinary skill in the art would understand that modifications, variations, and combination are included within the scope of the present disclosure.

Figure 1:
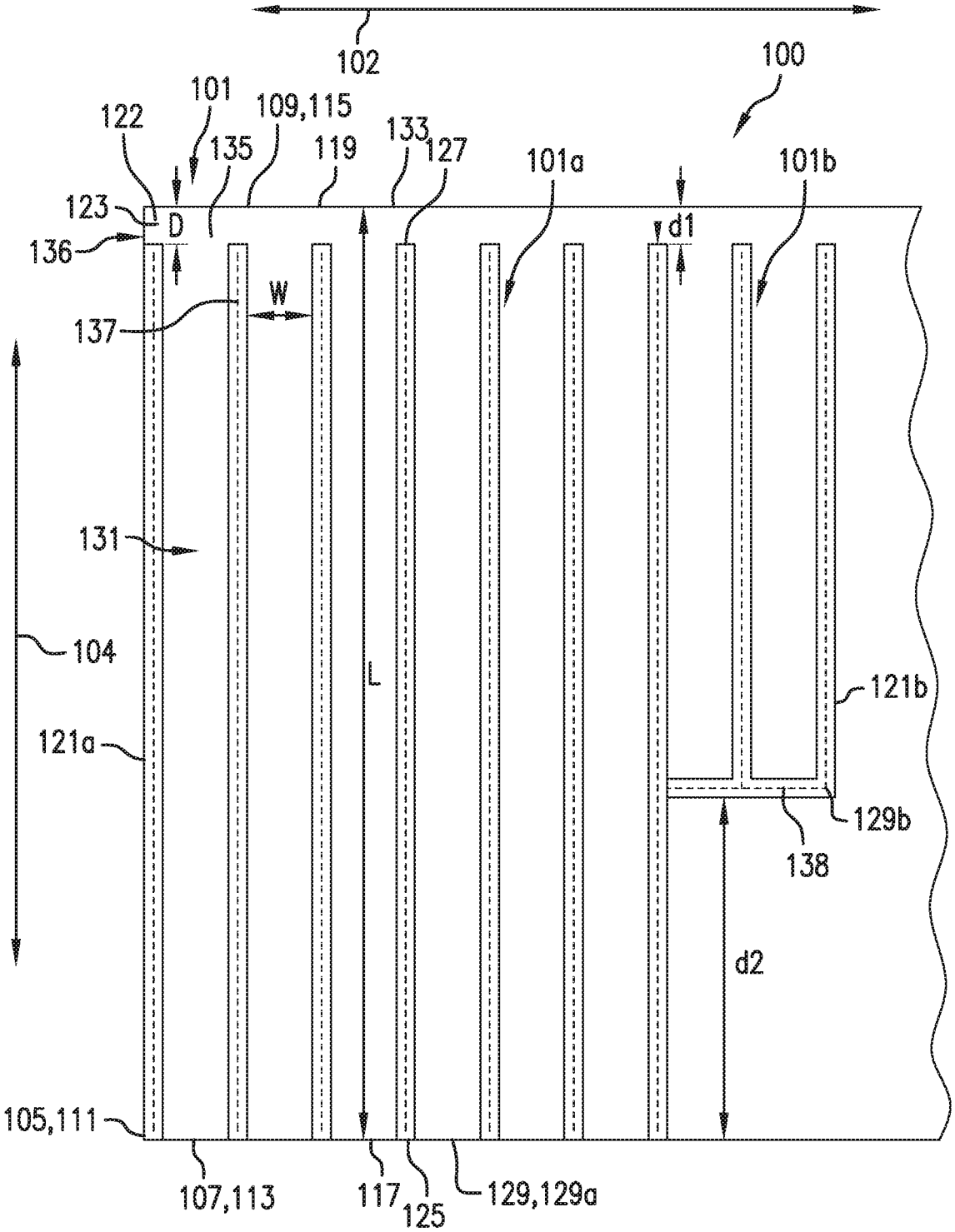
FIGS. 1-8 are top, plan views of uninflated flexible structures according to various embodiments.
Figure 2:
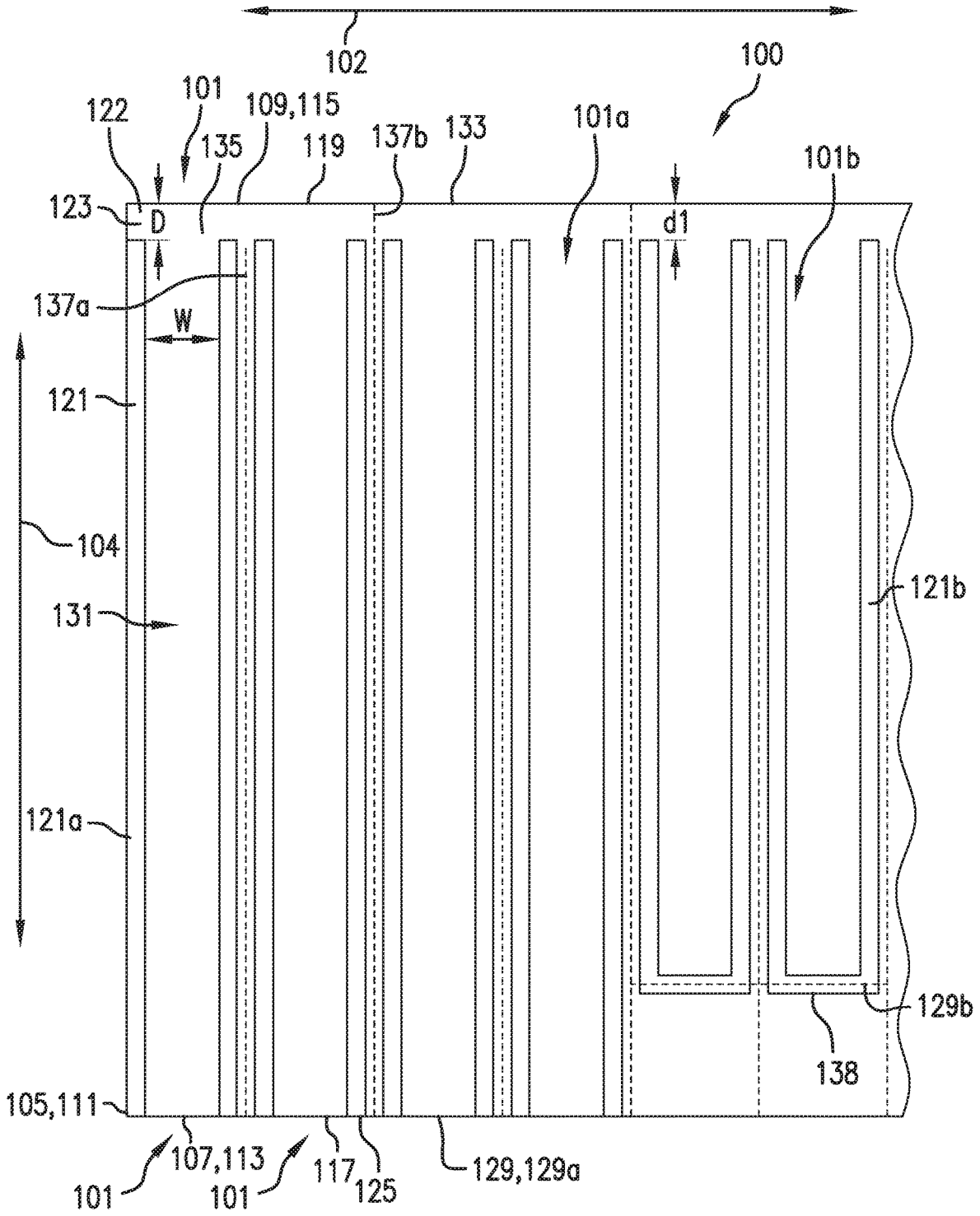

FIGS. 1-2 show a multi-ply flexible structure 100 for inflatable cushions that may be inflated and used as an inflated packaging element. The multi-ply flexible structure may have individual uninflated elements, pairs of uninflated elements, units of uninflated elements, and/or combinations thereof. In various embodiments, a unit of uninflated elements may be a various quantity of similar shaped uninflated elements. For example, a unit may be 2 similar shaped uninflated elements. In another example, a unit is a 20 similar shaped uninflated elements. In another example, a unit may be a combination of dissimilarly shaped elements. The unit of dissimilarly shaped elements may contain a various quantity of uninflated elements.

In accordance with various embodiments, the uninflated element is an uninflated shoe insert configured for placement in an individual shoe. For example, two individual uninflated inserts form a pair of uninflated inserts. A pair of uninflated inserts may have two individual uninflated inserts that are similarly shaped. A pair of uninflated inserts may be inflated and then assembled or packaged with a pair of shoes. One inflated insert of the pair of inserts is positioned within one shoe of the pair of shoes. For example, a first pair of uninflated inserts may have two similarly shaped uninflated inserts, one to be later inflated per individual shoe. One of uninflated insert may be differently shaped than a second uninflated insert that is also configured to be later inflated and packaged with a shoe. A later inflated insert may be positioned near the front portion or vamp region of the shoe, and another later inflated insert may be positioned in the rear portion or quarter region of the shoe. A unit of uninflated inserts may contain at least two pairs of uninflated inserts, and each pair may be dissimilarly shaped with the other pair of uninflated inserts.

In one example, the uninflated element is an uninflated shoe insert. The multi-ply structure 100 may have individual, similarly shaped uninflated inserts. In another example, the multi-ply structure 100 may have individual, dissimilarly shaped uninflated inserts. In another example, the multi-ply structure 100 may have multiple pairs of similarly shaped uninflated inserts, each pair of individual uninflated inserts being similarly shaped. In another example, the multi-ply structure 100 may have multiple pairs of dissimilarly shaped uninflated inserts, with each pair of individual uninflated inserts being similarly shaped. In another example, the multi-ply structure 100 may have multiple units of uninflated inserts, with similar and dissimilar pairs of uninflated inserts. In another example, the multi-ply structure 100 may have multiple units of individual inserts. In another example, the multi-ply structure 100 may have a combination of uninflated inserts, pairs of uninflated inserts, and units of uninflated inserts.

The individual inserts may have a single seal pattern or a variety of seal patterns to form inflation chambers of the inserts. The seal pattern may form the inflation chambers regardless if the insert is inflated and sealed using an inflating and sealing machine with continuous inflation, an inflation machine with valves, inflation and sealing machine that inflates and seals an individual insert, or an inflation machine that inflates individual inserts with valves.

With reference to FIGS. 1 and 2, a reference longitudinal direction 102 extends from the left side of the figure to the right side of the figure, for example from reference number 121*a* to reference number 121*b*. The longitudinal direction 102 may correspond to the direction in which the multi-ply structure 100 is fed into a machine for inflation. For example, a roll of the multi-ply structure 100 may extend for a few inches in the longitudinal direction or for several hundred feet.

For reference, the transverse direction 104 extends generally perpendicular to the longitudinal direction. The transverse direction 104 may correspond to an overall width of the multi-ply structure 100. For example, a roll of the multi-ply structure 100 may have a width in the transverse direction that is a few inches wide up to a few feet wide.

The flexible structure 100 of FIGS. 1 and 2 includes a first film ply 105 having a first longitudinal edge 107 extending in the longitudinal direction 102 and a second longitudinal edge 109 extending in the longitudinal direction 102, and a second film ply 111 having a first longitudinal edge 113, and a second longitudinal edge 115. The second ply 111 is aligned to be overlapping and can be generally coextensive with the first ply 105 i.e., at least respective first longitudinal edges 107, 113 are aligned with each other and/or second longitudinal edges 109, 115 are aligned with each other. In some embodiments, the plies can be partially overlapping with inflatable areas in the region of overlap.

In some examples, the first and second plies 105, 111 join to define a first longitudinal edge 117 and a second longitudinal edge 119 (both extending in the longitudinal direction 102) of the film 100. The first and second plies 105, 111 can be formed from a single sheet of flexible structure material, a flattened tube of flexible structure with one edge having a slit or being open, or two sheets of flexible structure. For example, the first and second plies 105, 111 may be formed from a single sheet of flexible structure 100 that is folded to define the joined second edges 109, 115 (e.g., "c-fold film"). Alternatively, for example, the first and second plies 105, 111 can include a tube of flexible structure (e.g., a flattened tube) that is slit along the aligned first longitudinal edges 107, 113 or the second aligned longitudinal edges 109, 115. Also, for example, the first and second plies 105, 111 can include two independent sheets of flexible structure joined, sealed, or otherwise attached together along the aligned first longitudinal edges 107, 113 or the second aligned longitudinal edges 109, 115.

The flexible structure 100 can be formed from any of a variety of web materials known to those of ordinary skill in the art and as such the flexible structure 100 may also be referred to as a web or web 100 herein. Such web materials include, but are not limited to ethylene vinyl acetates (EVAs), metallocenes, polyethylene resins such as low density polyethylene (LDPE), linear low density polyethylene (LLDPE), and high density polyethylene (HDPE), and blends thereof. Other materials and constructions can be used. The disclosed flexible structure 100 may be rolled on a hollow tube, a solid core, or folded in a fan-folded box or in another desired form for storage and shipment.

In some embodiments, the web plies 105, 111 are between 10 and 100 microns thick. In some embodiments, the web plies 105, 111 are at least 20 microns thick. For example, in an embodiment, the web plies 105, 111 may be between 50 and 75 microns thick.

In some embodiments, the web plies 105, 111 are made from a co-extruded material that contains nylon. For example, the web plies 105, 111 may be made from polyethylene and nylon. Materials containing nylon serve as an air barrier and retain the air over the shipping and storage cycle of shoes. Other suitable materials and constructions can be used.

A multiply web 100 may be made of a monolayer or multilayer polymeric film material. Each ply may be made from a monolayer or multilayer film. Monolayer films are typically made of polyethylene, although other suitable polymers may be used. The one or more layers of multilayer film embodiments may include polymers of differing compositions. In some embodiments, the disclosed layers may be selected from ethylene, amide, or vinyl polymers, copolymers, and combinations thereof. The disclosed polymers can be polar or non-polar. The disclosed ethylene polymers may be substantially non-polar forms of polyethylene. In many cases the ethylene polymer may be a polyolefin made from copolymerization of ethylene and another olefin monomer, for example an alpha-olefin. The ethylene polymer may be selected from low, medium, or high density polyethylene, or a combination thereof. In some cases, the density of various polyethylenes may vary, but in many cases the density of low density polyethylene may be, for example, from about 0.905 or lower to about 0.930 g/cm3, the density of medium density polyethylene may be, for example, from about 0.930 to about 0.940 g/cm3, and high density polyethylene may be, for example, about 0.940 to about 0.965 g/cm3 or greater. Other suitable densities of various polyethylenes may be used. The ethylene polymer may be selected from linear low density polyethylene (LLDPE), metallocene linear low density polyethylene (mLLDPE), high density polyethylene (HDPE), medium density polyethylene (MDPE), and low density polyethylene (LDPE).

In some embodiments, the polar polymer may be a non-polar polyethylene which may be modified to impart a polar characteristic. In other embodiments the polar polymer is an ionomer (e.g. copolymers of ethylene and meth acrylic acid, E/MAA), a high vinyl acetate content EVA copolymer, or other polymer with polar characteristics. In one embodiment the modified polyethylene may be anhydride modified polyethylene. In some embodiments, the maleic anhydride is grafted onto the olefin polymer or copolymer. Modified polyethylene polymers may react rapidly upon coextruding with polyamide and other ethylene containing polymers (e.g., EVOH). In some cases a layer or sublayer comprising the modified polyethylene may form covalent bonds, hydrogen bonds and/or, dipole-dipole interactions with other layers or sublayers, for example sublayers or layers comprising a barrier layer. In many embodiments, modification of a polyethylene polymer may increase the number of atoms on the polyethylene that are available for bonding. For example, modification of polyethylene with maleic anhydride adds acetyl groups to the polyethylene, which may then bond with polar groups of the barrier layer, for example hydrogen atoms on a nylon backbone. Modified polyethylene may also form bonds with other groups on the nylon backbone as well as polar groups of other barrier layers, for example alcohol groups on EVOH. In some embodiments, a modified polyethylene may form chain entanglements and/or van der Waals interactions with an unmodified polyethylene.

The layers of the plies 105, 111 may be adhered or otherwise attached together, for example, by tie layers. In other embodiments, one or more of the plies 105, 111 are a single layer of material, for example, a polyethylene layer.

Mixtures of ethylene and other molecules may also be used. For example, ethylene vinyl alcohol (EVOH) is a copolymer of ethylene and vinyl alcohol. EVOH has a polar character and can aid in creating a gas barrier. EVOH may be prepared by polymerization of ethylene and vinyl acetate to give the ethylene vinyl acetate (EVA) copolymer followed by hydrolysis. EVOH can be obtained by saponification of an ethylene-vinyl acetate copolymer. The ethylene-vinyl acetate copolymer can be produced by a known polymerization, such as solution polymerization, suspension polymerization, emulsion polymerization and the like, and saponification of ethylene-vinyl acetate copolymer can be also carried out by a known method. Typically, EVA resins are produced via high pressure autoclave and tubular processes.

Polyamide is a high molecular weight polymer having amide linkages along the molecular chain structure. Polyamide is a polar polymer. Nylon polyamides, which are synthetic polyamides, have favorable physical properties of high strength, stiffness, abrasion and chemical resistance, and low permeability to gas, for example oxygen.

As shown in FIGS. 1-2, the flexible structure 100 may include a series of narrow width and long length individual uninflated inserts 101. Each individual uninflated insert 101 may have a length that extends in the transverse direction 104, and a width that extends in the longitudinal direction 102. This differs from the multi-ply structure 100 that contains the multiple inserts, as the multi-ply structure 100 may have a width that extends in the transverse direction 104 and a length that extends in the longitudinal direction 102.

In accordance with various embodiments, each insert 101 includes a series of seals 121 disposed along the longitudinal extent of the flexible structure 100. The transverse seal 121 extends in the transverse direction 104. For each insert 101, the transverse seal 121 extends across a portion of the distance between the first longitudinal edge 117, and in the embodiment shown, towards the second longitudinal edge 119 (also extending in the longitudinal direction). Each transverse seal 121 can have a first end 125 proximate the first longitudinal edge 117 and a second end 127 proximate the inflation region 123. In some embodiments, the second end 127 may be spaced a dimension d1 (extending in the transverse direction 104) away from the second longitudinal edge 119. In some embodiments, the flexible structure 100 may also include a first longitudinal seal 129 proximate the first longitudinal edge 117 (for example, when the first and second plies 105, 111 include two independent sheets of flexible structure, the sheets 105, 111 may be joined, sealed, or otherwise attached together at the first longitudinal seal 129 aligned with the first longitudinal edges 107, 113). While the longitudinal seal 129 may be located at the longitudinal edge 117, they also may be offset from the longitudinal edge 117. In some examples the transverse seals 121 may extend to the longitudinal seal 129. In other embodiments, the transverse seal 121 may have the first end 125 proximal to the longitudinal seal 129 without intersecting the longitudinal seal 129. In other embodiments, the transverse seal 121 may intersect the longitudinal seal 129 and extend past it.

A chamber 131 is defined within a boundary formed by the first longitudinal edge 117 and a pair of adjacent seals 121 for each insert 101. The chamber 131 is configured to be inflated via the inflation region 123.

The inflation region 123 may be formed along the second longitudinal edge 119. In some embodiments, such as FIGS. 1 and 2, the inflation region 123 may be a partially closed passageway that forms a longitudinal inflation channel (extending in the longitudinal direction 102). The inflation channel may be defined by a seal proximal to longitudinal the longitudinal edge 119. In other embodiments, the longitudinal edge may be partially sealed or open allowing a nozzle to force air in across the edge. Thus an inflation region 123 can have an open edge, a partial seal or complete seal proximal to the longitudinal edge 119 and formed between the second ends 127 of the seals 121 and the second longitudinal edge 119 and that extends across multiple uninflated inserts 101 in the longitudinal direction 102. In some embodiments an inflation opening 136 is disposed on at least one end of the longitudinal inflation region 123 and the second longitudinal edge 119 is sealed via the second longitudinal seal 133.

In some examples, the inflation opening 136 is positioned in the transverse direction 104, and allows for a nozzle to be inserted into the inflation opening 136, the nozzle polsitioned in the longitudinal direction 102. The inflation region 123 may have a width of dimension D extending in the transverse direction 104. In some examples, dimension D is similar to the dimension d1, the distance between the second end 127 of the transverse seal 121 and the second longitudinal edge 119. In other examples, specifically in embodiments having a longitudinal seal 133, the dimension D is smaller than dimension d. In some embodiments, the second longitudinal seal 133 may be proximate or collinear with the second longitudinal edge 119. In other embodiments, the second longitudinal seal 133 is proximal to but offset from the second longitudinal edge 119. The second longitudinal seal 133 may form the portion of the inflation region 123 in embodiments with an inflation channel 122. In some embodiments with the second longitudinal seal 133, the width D is smaller than d1 by a value of the thickness of the second longitudinal seal 133.

In some examples, an inflation region 123 includes the two ends of plies 105, 111 that form an inflation opening extending in the longitudinal direction 102 generally parallel with the second longitudinal side 119, such that an air nozzle outlet may be aligned in the transverse direction 104 and positioned between the second longitudinal edges 109, 115 of the plies 105, 111 (that form the second longitudinal edge 119) to inject air into the uninflated chamber to later form an inflated insert. The second longitudinal edge 119 is not sealed by the second longitudinal seal 133 in this example.

In other examples, the inflation region and opening may be positioned near the center (with respect to the transverse direction 104) of the structure 100 with uninflated inserts (extending in the transverse direction 104) positioned on either side of the inflation opening.

In accordance with some embodiments, each of the transverse seals 121 as embodied in FIGS. 1-2 can be substantially straight and/or extend substantially perpendicular to the first longitudinal edge 117. In embodiments including the first longitudinal seal 129, the first longitudinal edge 117 can be collinear with the first longitudinal seal 129. The first end 125 of the transverse seal 121 may intersect (e.g. at a perpendicular angle) the first longitudinal edge 117 or the first longitudinal seal 129. In some embodiments, the first longitudinal seal 129*b* is offset away from the first longitudinal edge 117 towards the second longitudinal edge 119 by a dimension d2. In some embodiments, the distance between the first longitudinal edge 119 and a first embodiment of first longitudinal seal 129*a* is smaller than a dimension d2 (the distance between the first longitudinal edge 119 and a second embodiment of first longitudinal seal 129*b*). In the aforementioned example, the overall length of a transverse seal 121*a* is longer than that of a transverse seal 121*b*. In some embodiments, the flexible structure 100 may include seals 121 with multiple lengths having multiple d2 values.

The seals 121 as well as the longitudinal seal 129 may be formed from any variety of techniques known to those of ordinary skill in the art. Such techniques include, but are not limited to, adhesion, friction, welding, fusion, heat sealing, laser sealing and ultrasonic welding of the two plies 105, 111.

The first and second longitudinal edges 117, 119 and seals 121 cooperatively define boundaries of inflation chambers 131 for each uninflated insert 101. As shown in FIG. 1, each inflation chamber 131 is in fluid communication with the longitudinal inflation region 123 via the mouth 135 opening towards the longitudinal inflation region 123, thus permitting inflation of the inflation chambers 131 as further described herein.

In some examples, the seals and/or edges define an inflation port for feeding fluid into the inflation chambers, and the inflation ports are sealable for sealing the fluid in the inflation chambers. In some examples, the port is oriented to be sealable by a seal oriented generally parallel to the inflation region. In some examples, the pattern of seals and/or edges form an inflation region between the opposing plies, and the inflation chamber is in fluid communication with the inflation ports for inflating a plurality of inflation chambers through the inflation region and inflation region. In some examples, the inflation region is a circumferentially closed inflation region that directs the fluid to a plurality of the inflation ports.

In some examples, the opposing plies of the uninflated element may have a seal pattern that defines multiple uninflated elements that are separated from each other by a line of weakness. In some embodiments, the lines of weakness form a perimeter around the uninflated element that enable the uninflated elements to be separated from each other. In other embodiments, the lines may traverse a portion of or all of the transverse width of the flexible structure 100. The lines of weakness may also allow excess material to be removed from the uninflated elements. For example, the various lines of weakness may allow for excess material to be removed from a part of the inflated elements or the entire perimeter. The lines of weakness may be straight, curved, or any suitable shape. The may be positioned on top of or collinear with a seal, or positioned adjacent a seal.

In accordance with various embodiments, as shown in FIGS. 1 and 2, a series of lines of weakness 137 extend across the first and second plies of the structure 100. The lines of weakness may extend in the generally traverse direction. The lines of weakness may be disposed at intervals along the longitudinal direction 102 of the flexible structure 100 for each insert 101. In some examples, for each insert 101, each line of weakness 137 extends at least part way across the transverse direction. For example, they may extend from the first longitudinal edge 117 and towards the second longitudinal edge 119. Each line of weakness 137 in the flexible structure 100 may be disposed between a pair of adjacent seals 121 that form an individual inflation chamber 131 (see FIG. 2) or extend through a portion of or through the entire length of a single transverse seal 121 (see FIG. 1). The lines of weakness 137 facilitate the separation of adjacent inserts 101 after inflation. In some embodiments (see FIG. 2), a line of weakness 137*a* may extend from the first longitudinal edge 117 to the inflation region 123 (similar to FIG. 1). In some embodiments, additional lines of weakness 137*b* extend from an area proximal to the first longitudinal edge 117 to the inflation region or the second longitudinal edge 119. In accordance with various embodiments, the various lines of weakness may alternate lengths along the longitudinal extent of flexible structure 100. In the embodiment of FIG. 2, the variation of lengths of lines of weakness 137*a* and 137*b* allows for a pair of later inflated inserts to be separated from the structure 100 along line of weakness 137*b* as a pair so that the pair of inflated inserts may be used with a pair of shoes being prepared for shipment. The pair of inflated inserts still attached via the un-weakened segment at the end of the line of weakness 137*a* may then be later individually separated along line of weakness 137*a* to each be installed within an individual shoe of the pair of shoes.

In accordance with various embodiments, as shown in FIGS. 1-2, the flexible structure 100 can also include one or more longitudinal lines of weakness 138. The line of weakness 138 may be similar to the line of weakness 137, except that the line of weakness 138 extends in the longitudinal direction 102. In the example of FIGS. 1 and 2, the line of weakness 138 extends between seals 121*a* and 121*b*, extends through longitudinal seal 129*b*, and is offset from the first longitudinal edge 117. The line of weakness 138 allows the additional uninflated material for an insert 101*b* with a shorter length (as shown in the transverse direction 104) than that of insert 101*a* to be separated from the insert 101*b*.

The lines of weakness 137, 138 can include a variety of lines of weakness known by those of ordinary skill in the art. For example, in some embodiments, the lines of weakness 137 includes rows of perforations, in which a row of perforations includes alternating lands and slits spaced along the transverse extend of the row. The lands and slits can occur at regular or irregular intervals along the transverse extent of the row. Alternatively, in some embodiments, the lines of weakness 137 include score lines or the like formed in the flexible structure. The lines of weakness 138 may include similar features.

The lines of weakness 137, 138 may be formed from a variety of techniques known to those of ordinary skill in the art. Such techniques include, but are not limited to, cutting (e.g., techniques that use a cutting or toothed element, such as a bar, blade, block, roller, wheel, punch, or the like) and/or scoring (e/g/, techniques that reduce the strength or thickness of material in the first and second plies, such as electromagnetic (e.g., laser) scoring and mechanical scoring.)

In the embodiments of FIGS. 1 and 2, the inserts 101 may form a long, slender tube when later inflated. Each individual uninflated insert 101 may have a length that extends in the transverse direction 104, and a width that extends in the longitudinal direction 102. In some embodiments, a width W (extending in the longitudinal direction 102 of the uninflated structure 100 in the embodiments shown) of the insert 101 may be in a range of 2 cm up to 10 cm. The width W of the uninflated insert 101 directly controls the width of the later inflated insert. A length L (extending in the transverse direction 104) of the insert 101 may be in the range from 15 cm up to 160 cm. As shown in FIG. 1, the inserts 101 may have different lengths based upon the length of seals 121*a* and 121*b* and the position of the first longitudinal edge 117 (when structure 100 is a c-fold or flattened tube) or the longitudinal seals 129*a* (using two individual sheets 105, 107) or longitudinal seal 129*b*.

In some examples, the uninflated inserts 101 are configured to be inflated and used in kids or adult shoes, ranging from US size 1 to US size 16. For example, a size 1 shoe may correspond to a foot length of 20 cm and a size 16 shoe may correspond to a foot length of 32 cm. The insert 101 has a high aspect ratio of length to width such that the insert 101 may later be inflated and easily folded about its width. In an example, the aspect ratio is at least 4:1. In another example, the aspect ratio is at least 10:1. In another example, the aspect ratio may be as high as 20:1 or 30:1.

Generally, a shoe has an upper and a sole. The upper of the shoe contains the sections of the shoe above the sole. The upper of the shoe has a vamp (or front of the shoe) and quarter (the sides and the back of the shoe). In some examples, the vamp includes the toe and tongue (if the shoe has a tongue). In some examples, the quarter include a rear quarter section where a user's heel may be positioned, and side quarter sections that include a lateral and medial sides of the shoes up to where they connect with the vamp.

In some examples, the length L of the inserts 101 corresponds to a value that is about twice up to three times the length of a shoe the insert will be installed within. This allows for the uninflated insert to be inflated and later folded in half or in thirds to be positioned in a shoe, so that portions of the vamp area and quarter area of the shoe may be supported. In some examples, the insert 101 length is less than twice that of the length of the shoe it will be installed within, such as when the shoe has a narrow vamp portion and the folded insert will not extend fully between the front and rear of the shoe. In other examples, the length L of the insert 101 is less than the length of the shoe, the insert is not folded about its width, and the insert is configured to be positioned in the quarter region of the shoe (see FIGS. 12A-C). In some examples, the length L is greater than twice the length of the shoe, such as when the insert 101 may be folded multiple times and placed within the shoe. The length of the uninflated insert will generally be the length of in inflated insert.

In some examples, the uninflated element may be differently shaped than that of the inserts of FIGS. 1 and 2. The uninflated element may have a combination of seals positioned around the perimeter of the element and within the perimeter of the element.

Figure 3:
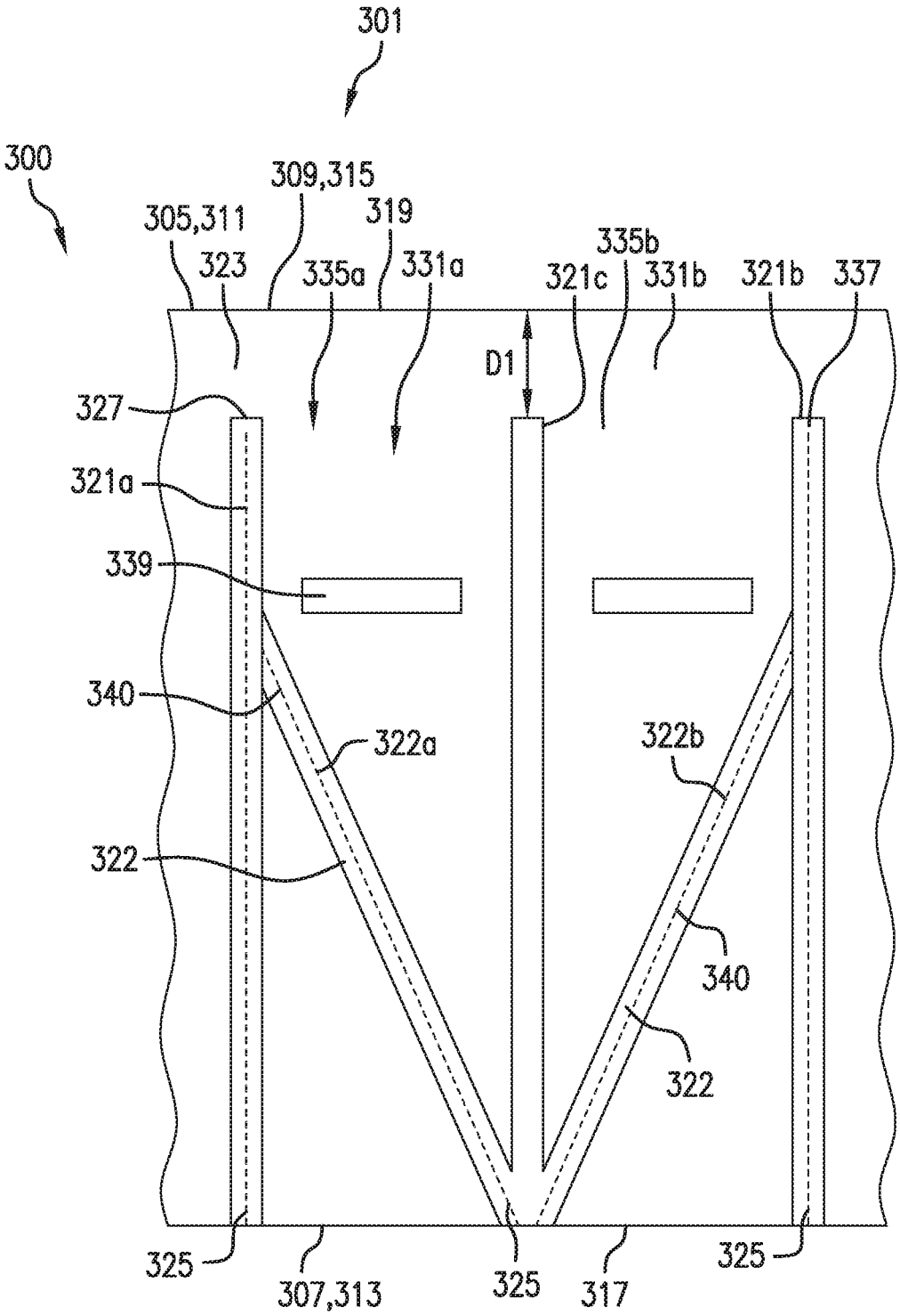

FIG. 3 is a top plan view of an uninflated flexible structure 300 according to an additional embodiment. FIG. 3 shows an uninflated flexible structure 300 with some features similar to the structure 100 shown in FIGS. 1 and 2, with an example of a single insert 301 formed in the multi-ply flexible structure 300. The flexible structure 300 includes a first film ply 305 having a first longitudinal edge 307 and a second longitudinal edge 309, and a second film ply 311 having a first longitudinal edge 313, and a second longitudinal edge 315. The second ply 311 is aligned to be overlapping and can be generally coextensive with the first ply 305 i.e., at least respective first longitudinal edges 307, 313 are aligned with each other and/or second longitudinal edges 309, 315 are aligned with each other. In some embodiments, the plies can be partially overlapping with inflatable areas in the region of overlap. The plies 305 and 311 may be constructed of similar materials and produced similar to the plies 105 and 111 of structure 100.

As shown in FIG. 3, the insert 301 of the flexible structure 300 may include a series of transverse seals 321 disposed along the longitudinal extent of the insert 301. Each transverse seal 321 extends a portion of the distance between first longitudinal edge 317, and towards the second longitudinal edge 319. In various embodiment, each seal 321 can be similar to the previously discussed transverse seals 121. For example, seal 321 can include a first end 325 proximate the first longitudinal edge 317 or the first longitudinal seal 329 and a second end 327 proximate the second inflation region 323. In some embodiments, the second end 327 may be spaced a transverse dimension d1 away from the second longitudinal edge 319. In accordance with one example as illustrated in FIG. 3, the insert 301 can include at least three seals 321, identified as 321*a*, 321*b*, 321*c*, with the seals 321 being generally perpendicular to at least one of the first longitudinal edge 319 or second longitudinal edge 317. In some embodiments, the flexible structure 300 also includes a first longitudinal seal 329 proximate the first longitudinal edge 317 (for example, when the first and second plies 305, 311 include two independent sheets of flexible structure, the sheets 305, 311 may be joined, sealed, or otherwise attached together at the first longitudinal seal 329 aligned with the first longitudinal edges 307, 313).

In the embodiment of FIG. 3, additional angled seals 322, having both a longitudinal and transverse component to their direction extending across the flexible structure 300, connect or are adjacent to the seals 321. In accordance with various examples as shown in FIG. 3, angled seal 322*a* connects seal 321*a* with seal 321*c*, and angled seal 322*b* connected seal 321*b* with seal 321*c*, such that the angled seal 322*s* and 322*b* form two sides of a triangle or a form a point in the near the first longitudinal edge 317. The angled seals 322*a*, 322*b* may intersect with the seal 321*c* at the first end 325 of the seal 321*c*. An inflation chamber 331*a* is defined within a boundary formed by seals 321*a*, 321*c*, the angled seal 322*a* and the second longitudinal edge 319. An inflation chamber 331*b* is defined within a boundary formed by seals 321*b*, 321*c*, the angled seal 322*b* and the second longitudinal edge 319.

In the example of FIG. 3, angled lines of weakness 340 may be positioned adjacent to, parallel with, or extending collinearly with the angled seals 322 and intersect with the lines of weakness 337. The angled lines of weakness 340 may be formed similarly to the lines of weakness 337, and allow for the individual inserts to be separated from other inserts on the multi-ply structure 100 after inflation and may also allow uninflated portions of the inserts 301, such as excess material, to be separated from inflated portions of the insert 301.

Intermediate seals 339 may be located within the chambers 331*a* between the intersection of the angled seal 322*a* and the seal 321*a* and seal 321*c*, and within chamber 331*b* between the intersection of the angled seal 322*b* and the seal 321*b* and seal 321*c*. In some embodiments, the intermediate seals 339 connect to or intersect with the seals 321*a*, 321*b*. In some embodiments, the intermediate seals 339 connect to the seal 321*c*. In some embodiments, as shown in FIG. 3, the intermediate seals do not intersect with or connect to the seals 321*a*, 321*b*, 321*c* or the angled seals 322*a*, 322*b*. In some embodiments, the seals and intermediate seals define a plurality of individual inflation chambers that are separate from each other.

The intermediate seals 339 may act as flexible members or joints when the flexible structure 300 is later inflated and sealed, such that the inflated insert may be manipulated about itself along the intermediate seal 339. The location of intermediate seals 339 may be at a ratio of about ⅙ to ½ of the overall length of the seals 321, with the position of the intermediate seals 339 measured from the second end 327 of the seal 321 proximate the second longitudinal edge 319.

Similar to FIGS. 1 and 2, the insert 301 formed from the flexible structure 300 may have an inflation region and the structure 300 and insert 301 may be inflated and sealed similarly to methods, systems, and devices discussed with regard to the inflation and sealing of FIGS. 1 and 2. The inflation region 323 may be fluidly connected to inflation chambers 331*a*, 331*b* through mouth openings 335*a*, 335*b*. Also similar to FIGS. 1 and 2, lines of weakness 337 may be positioned on the outside of seals 321*a*, 321*c* (shown in FIG. 3) for each individual insert 301, or they may intersect the length of the seals 321*a*, 321*c* for each individual insert 301.

The overall length of the uninflated insert 301 may be similar to or longer than the length of the vamp region of a shoe. When the length of the insert is longer than the length of the vamp region of the shoe, the insert 301 may be inflated and then folded about the intermediate seals 339. The position of the intermediate seals with respect to the overall length of the insert influences how the insert may be flexibly folded upon itself to manipulate the length of the insert once installed within the shoe. This allows for customization of vamp support, such that an insert may be configured to support shoes having a variety of vamp shapes and sizes.

Figure 4:
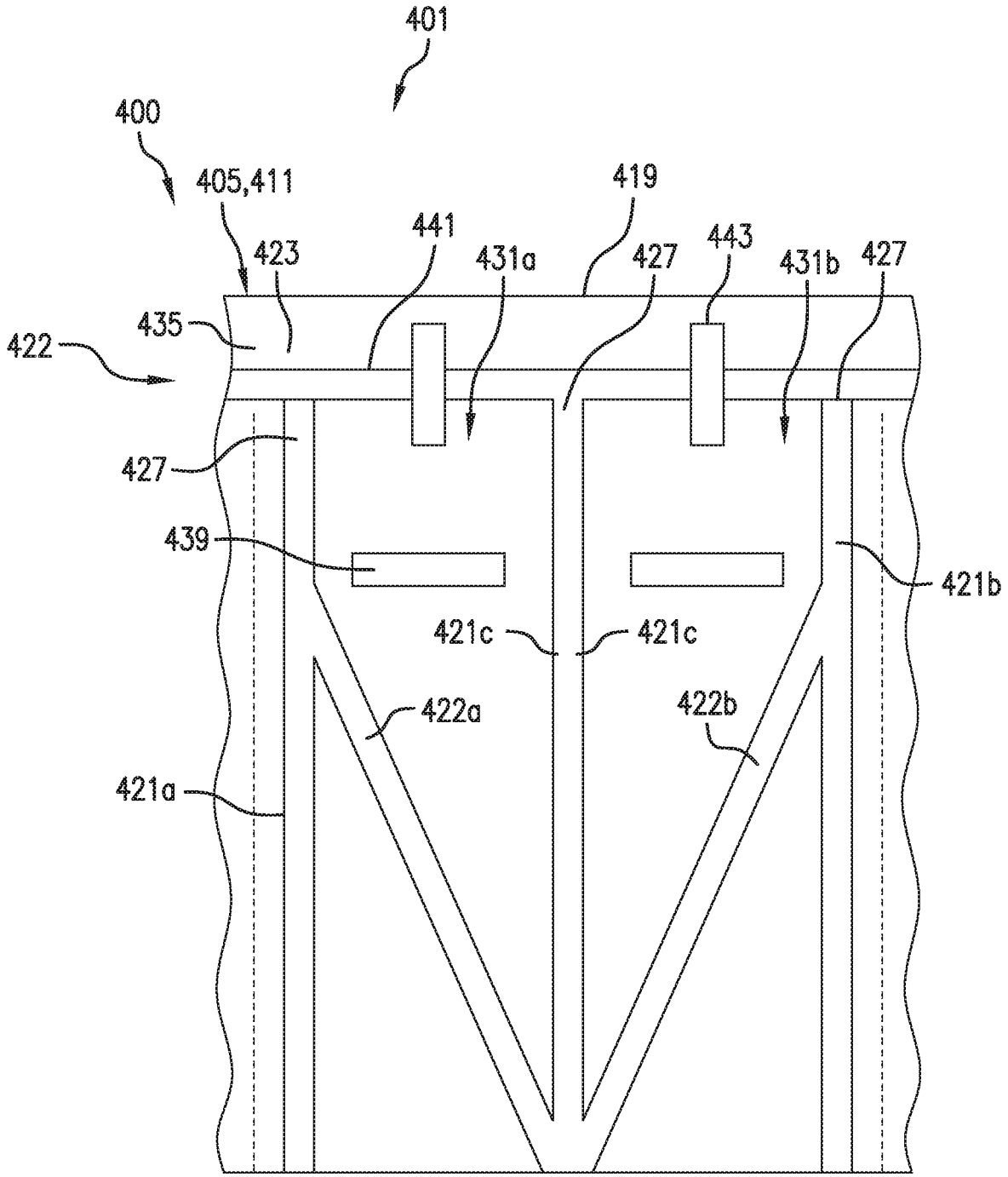

FIG. 4 is a top plan view of individual insert 401 of an uninflated flexible structure 400 according to an additional embodiment. The flexible structure 400 and insert 401 are similar to the flexible structure 300 and insert 301 of FIG. 3, including, for example, seals 421*a*, 421*b*, 421*c*, angled seals 422*a*, 422*b*, intermediate seals 439, and inflation region 423 adjacent the second longitudinal edge 419. The insert 401 of FIG. 4 differs from the insert 301 of FIG. 3 in the inflation region. Unlike the insert of FIG. 3, the mouths 335*a*, 335*b* are replaced with an additional valve intersecting seal 441 and valve 443. The valve intersecting seal 441 is positioned adjacent the second ends 427 of each seal 421*a*, 421*b*, 421*c* to form the inflation chambers 431*a* and 431*b* of the insert 401. One-way valves 443 (e.g., check valves) are positioned to intersect the valve intersecting seal 441 to fluidly connect the inflation region 423 with the inflation chambers 431*a* and 431*b*. The valve intersecting seal 441 and valve 443 allow the inserts 401 to be inflated one at a time or a few at a time, such as making a pair of inserts. It is contemplated that the structures of FIGS. 1-3, and FIGS. 5-15 described later may include a valve structure similar to the valves 443 of FIG. 4.

Figure 5:
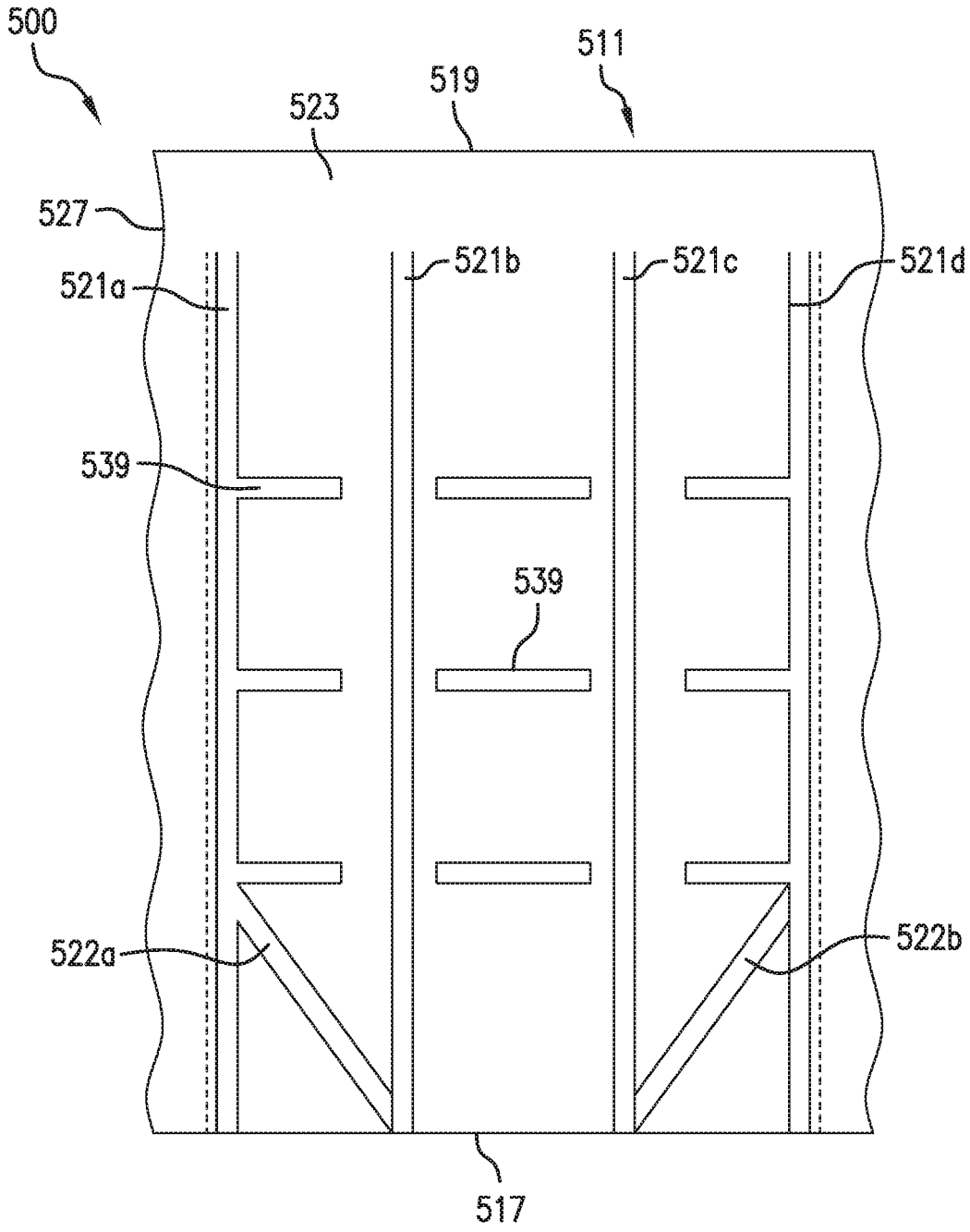

FIG. 5 is a top plan view of an insert 501 and uninflated flexible structure 500 according to an additional embodiment. The insert 501 and flexible structure 500 are similar to the insert 301 and flexible structure 300 of FIG. 3, including an inflation region 523, second longitudinal edge 519, intermediate seals 539, seals 521*a*, 521*b*, 521*c*, angled seals 522*a*, 522*b*. The insert 501 differs from the insert 301 of FIG. 3 in that there is an additional seal (521*d*) and the angled seal 522*a* connects seals 521*a* and 521*b*, and the angled seal 522*b* connects seals 521*d* and 521*c*. In addition, there are multiple intermediate seals 539 positioned between the first longitudinal edge 517 and the ends 527 of each seal 521. The intersection of the angled seals 522*a*, 522*b* with the respective outside seal 521*a*, 521*d* is located a distance of about ¼ to ¾ the overall length of the seal 521, as measured from the first longitudinal edge 517. A plurality of the intermediate seals 539 intersect with the seals 521*a*, 521*d* and the angled seals 522*a* and 522*b*.

Figure 6:
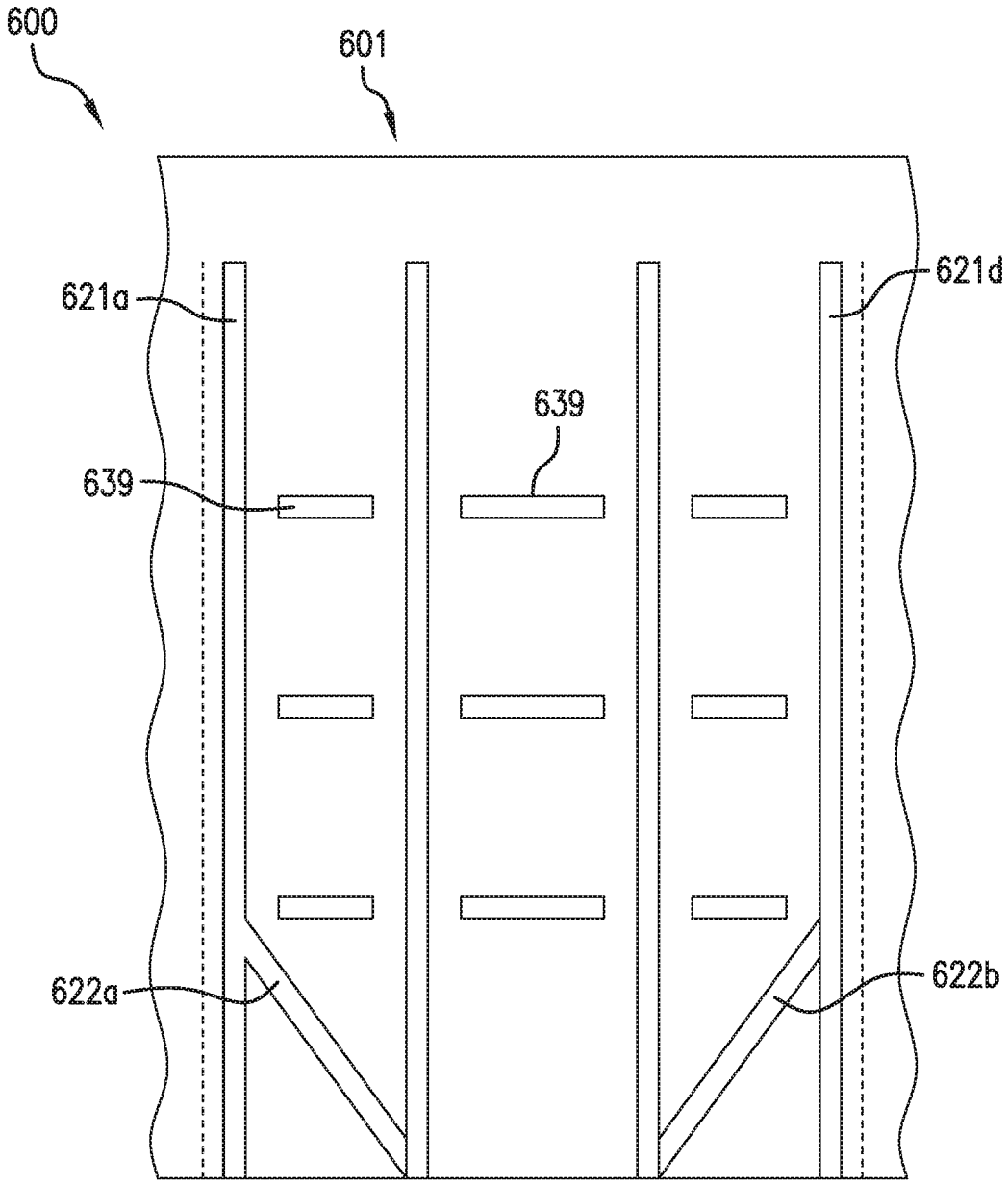

FIG. 6 is a top plan view of an insert 601 and uninflated flexible structure 600 according to an additional embodiment. The insert 601 and flexible structure 600 of FIG. 6 are similar to the insert 501 and flexible structure 500 of FIG. 5. Differences between the insert 601 and the insert 501 include the positioning the intermediate seals 539 in that they do not intersect the seals 621*a*, 621*d* or the angled seals 622*a*, 622*b*.

Figure 7:
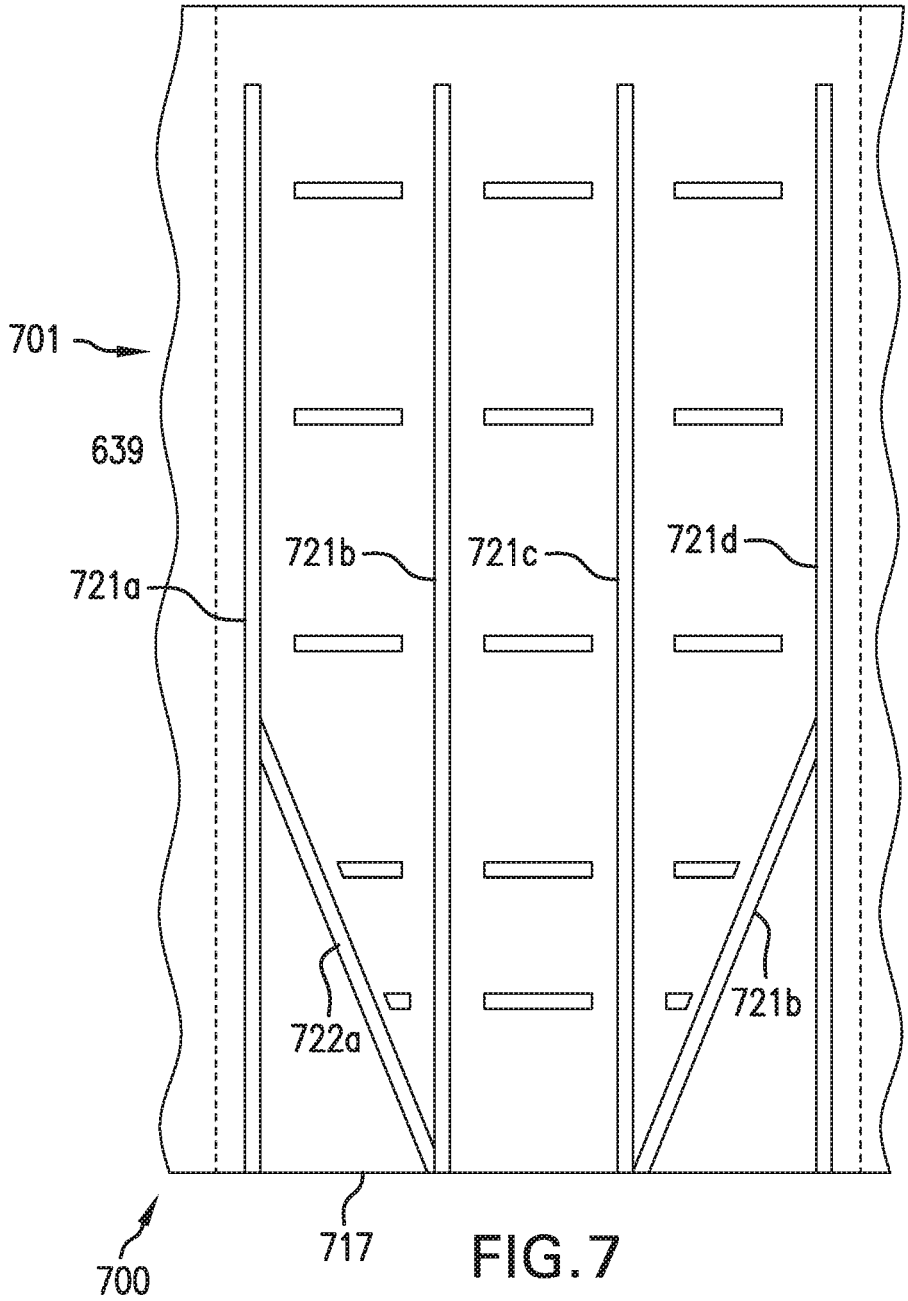

FIG. 7 is a top plan view of an insert 701 and uninflated flexible structure 700 according to an additional embodiment. The insert 701 and flexible structure 700 of FIG. 7 are similar to the insert 601 and flexible structure 600 of FIG. 6. Differences between the insert 701 and the insert 601 include the general intersection location of the angled seal 722*a* with the seal 721*a*, and the angled seal 722*b* with the seal 721*d*. The location of the intersection may be about ¼ to ¾ of the overall length of the seal 721, as measured from the first longitudinal edge 717.

Figure 8:
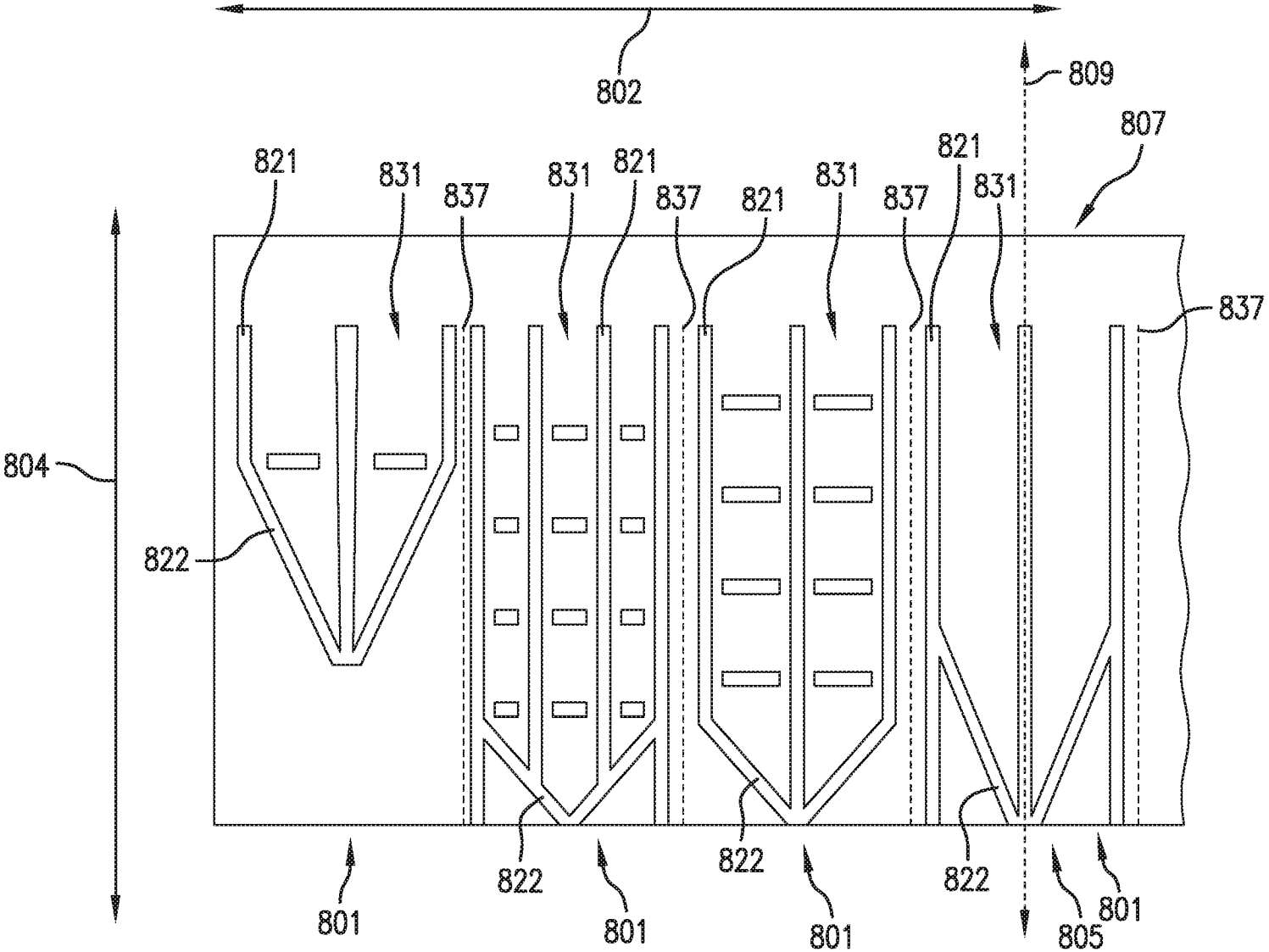

FIG. 8 is a top plan view of multiple inserts 801 of an uninflated flexible structure 800 according to an additional embodiment. FIG. 8 shows a structure 800 with inserts 801 having multiple sizes and shapes. In other examples, the structure 800 may have inserts 801 all having the same size and shape. In other examples, the structure 800 may have pairs of individual inserts, wherein the individual inserts forming the pair have a similar shape, but each pair has a different size or shape than other another pair. The inserts 801 may have a length that extends in a transverse direction 804, and a width extending in a longitudinal direction 802. The length of the inserts extends from a front region 805 to a rear region 807 with an anterior-posterior axis 809 extending there between. As shown in FIG. 8, the anterior-posterior axis 809 is oriented in the transverse direction 804, such that the length of the insert 801 is oriented in the transverse direction 804. In other examples, the inserts may be oriented so that the anterior-posterior axis 809 is oriented in the longitudinal direction 802. In other examples, the anterior-posterior axis 809 of the inserts may not be oriented in either the transverse direction 804 or the longitudinal direction 802.

The inserts 801 and structure 800 of FIG. 8 may be similar to the inserts 301, 401, 501, 601, 701 and flexible structures 300, 400, 500, 600, 700 of FIGS. 2-7, with each insert 801 having a plurality of inflation chambers, each insert 801 separated by lines of weakness 837, and each insert 801 having different shaped seals 821 and angled seals 822.

Figure 16:
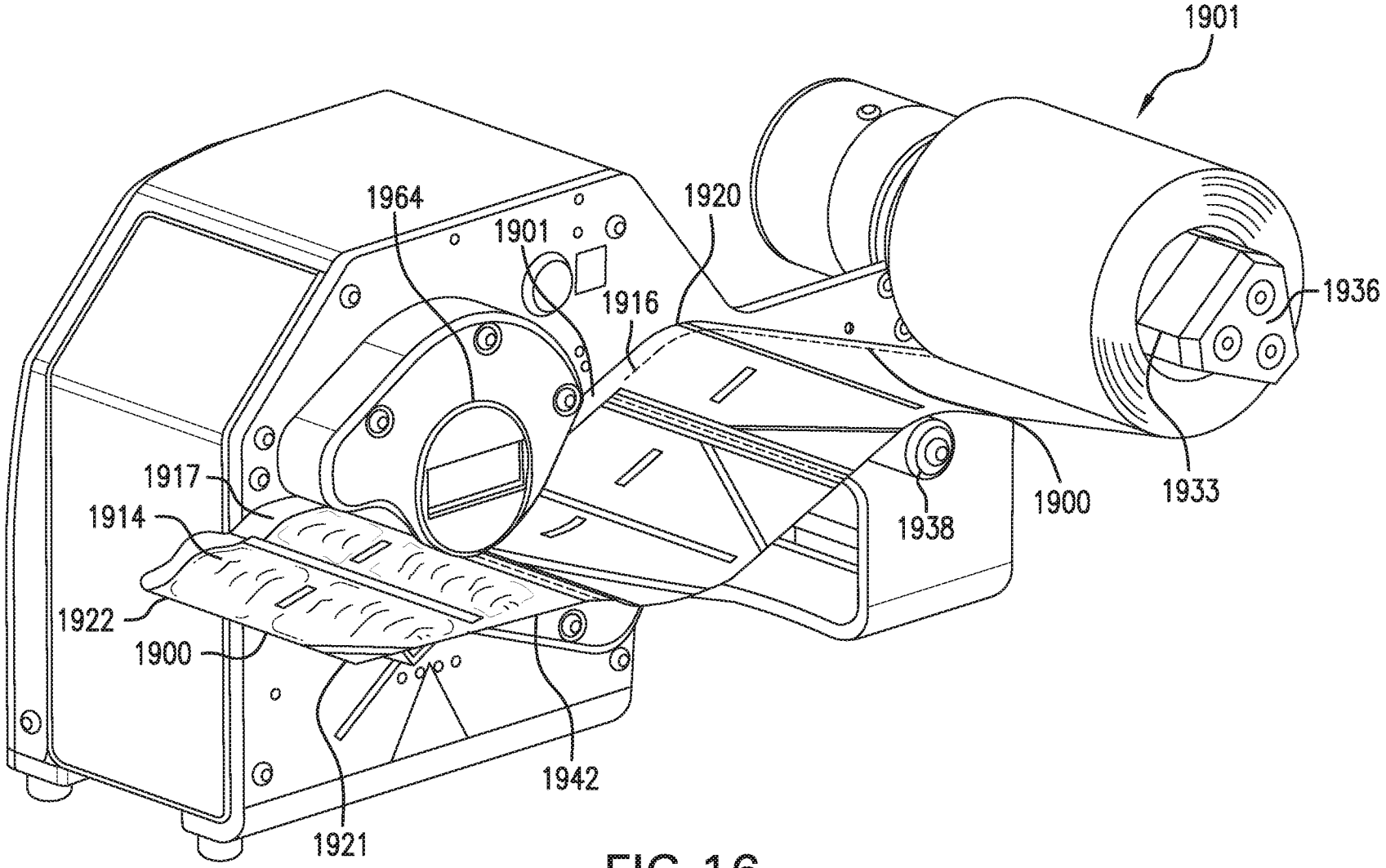
FIG. 16 is an example of a packaging and inflation sealing device for use in producing an embodiment of the shoe insert assembly.

FIG. 16 illustrates an example of an inflatable packaging sealing device 1901 that may be operated to convert a web 1900 of uninflated material into a series of uninflated shoe inserts by inflating air chambers 1914. The embodiments of FIGS. 1-3, and 5-8 may be inflated using an inflatable packaging sealing device 1901 to convert the uninflated material into a series of inflated shoe inserts by inflating chambers 131 and similar chambers. An uninflated web 1900 (and similar webs shown in FIGS. 2-3, 5-8) can be a bulk quantity of supply, for example a roll of web 1900 that is rolled around an inner support tube 1933. The inflation and sealing device 1901 may include a bulk material support 1936. The bulk quantity of uninflated web 1900 may be supported by the bulk material support 1936. For example, the bulk material support 1936 may be a tray operable to hold the uninflated web 1900, which can be provided by a fixed surface of a plurality of rollers, for example. TO hold the roll of web 1900, the tray may be concave around the roll or the tray may be convex with the roll suspended over the tray. The bulk material support 1936 may include multiple rollers which suspend the web 1900. The bulk material support 1936 may include a single roller or spindle that accommodates or is received within the center or the roll of the web 1900. The roll of web 1900 may be suspended over the bulk material support 1936, such as a spindle passing through the core 1933 of the roll of the web 1900. Typically, the roll core is made of cardboard of other suitable materials.

In accordance with the embodiments of FIGS. 1-3, and 5-8 and with reference to FIG. 16, a generally, a nozzle inflates the web 1900 through an inflation opening (e.g. inflation opening 136 of FIG. 1) of an inflation region (e.g. inflation region 123 of FIG. 1) as described above. The web 1900 may roll off of material support 1936 and over guide 1938 in a manner that aligns the inflation region of the web 1900 with the nozzle.

The inflation and sealing device 1901 is configured for continuous inflation of the web 1900 as it is unraveled from the roll. The roll of web 1900 includes a plurality of inflation chambers 1914 that are arranged in series. To begin manufacturing of the inflated shoe inserts 1921 from the web 1900, the inflation opening of the web 1900 is inserted around an inflation assembly, such as an inflation nozzle in the inflation region 1942. The web 1900 is advanced over the nozzle with the inflation chambers 1914 extending transversely with respect to the inflation nozzle and an outlet of the inflation nozzle. The outlet, which can be disposed on a radial side and/or upstream tip of the nozzle, for example, directs fluid into the nozzle body into the inflation chambers 1914 as the web 1900 advances along a material path in a longitudinal direction.

The inflation nozzle inserts fluid, such as pressurized air, along a fluid path into the uninflated web material through the nozzle outlets, inflating the inflation chambers 1914. The inflation nozzle can include a nozzle inflation channel that fluidly connects a fluid source with the nozzle outlets. It is appreciated that in other configurations, the fluid can be other suitable pressurized gas, foam, or liquid. The web 1900 is advanced or driven through the inflation sealing device 1901 by a drive mechanism, such as a driver, sealing drum, or a drive roller, or between a device of belts or pressure plates that can heat and press the plies together to form a heat seal, in a downstream direction along a material path.

After being fed through a web feed area 1964, the first and second plies (for examples, the sealing mechanism then forms a seal 1917 at the sealing location 1916 of the inflated web 1900 to close the mouth 1920 of each inflation chamber 1914. The sealing mechanism may include a sealing device to heat seal the plies of film together, such as with a heating element to melt, fuse, join, bind, or unite the two plies or other types of welding or sealing elements. The web 1900 is continuously advanced through the sealing assembly along the material path and past the sealing device at a sealing area to form a continuous longitudinal seal along the web by sealing the first and second plies together at the seal location 1916. The seal location 1916 abuts the seal 1922 so that when the plies are sealed along the seal location 1916, a seal 1917 is formed to seal the mouths 1920 shut, thereby forming a continuous seal around the inflation chamber 1914.

In accordance with various embodiments, the inflation and sealing device can have more than one belt. For example, one belt may drive the various rollers and a second belt may pinch the web against the sealing drum. In various embodiments, the inflation and sealing device may have no belts. For example, the sealing drum may pinch the web against a stationary platform and drive the web thorough the inflation and sealing device at the same time.

For embodiments in which a closed perimeter inflation region is used to receive the nozzle, the inflation and sealing device further can have a cutting assembly to cut the inflation region to allow the web to come off the inflation nozzle typically downstream of where the web is inflated.

The embodiment of FIG. 4 uses a different device than that of the device 1901 to inflate the inflation chambers. In the embodiment of FIG. 4, each of the one-way check-valves 443 fluidly connects the fluid conduit 423 to an inflation chamber 431*a*, 431*b*. In the uninflated state, the aperture 422 is closed and flat, and the check-valves 443 are in a closed position. Upon opening of the aperture 422 by the inflation nozzle, air can be delivered into the fluid conduit 423. Preferably, the operating pressure at which the air is delivered into the fluid conduit 423 opens the check-valves 443 to allow air to pass into the inflation chambers 431*a*, 431*b*. Once inflation of the each inflation chamber 431*a*, 431*b* is complete, the pressure of the air within each inflation chamber 431*a*, 431*b* acts against the check-valves 443 to keep the valves in the closed position, thus preventing air from escaping and the cushion from deflating. The inflation device used with the FIG. 4 embodiment may be configured to individually inflate a single insert, a pair of inserts, or multiple inserts with valves.

In other examples, inflation and sealing device may be configured to individually inflate and seal an uninflated element when the web comprises a single uninflated element, a pair of uninflated elements, or a combination of various sized uninflated elements.

The fluid flowing through the inflation and sealing device (e.g., air) may be regulated to equal to or greater than atmospheric pressure. Some typical air pressures are regulated between about 1 psi and 14 psi. For example, the air may be regulated to be between 3 psi and 8 psi in some embodiments.

Figure 9B:
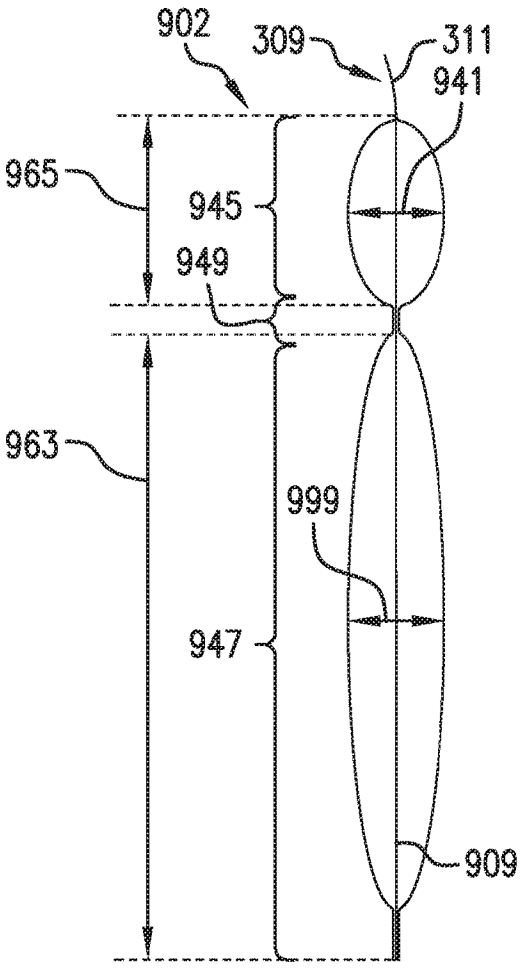
FIGS. 9A-B are top plan and side-elevation views of an inflated structure using the uninflated structure of FIG. 3.
Figure 9A:
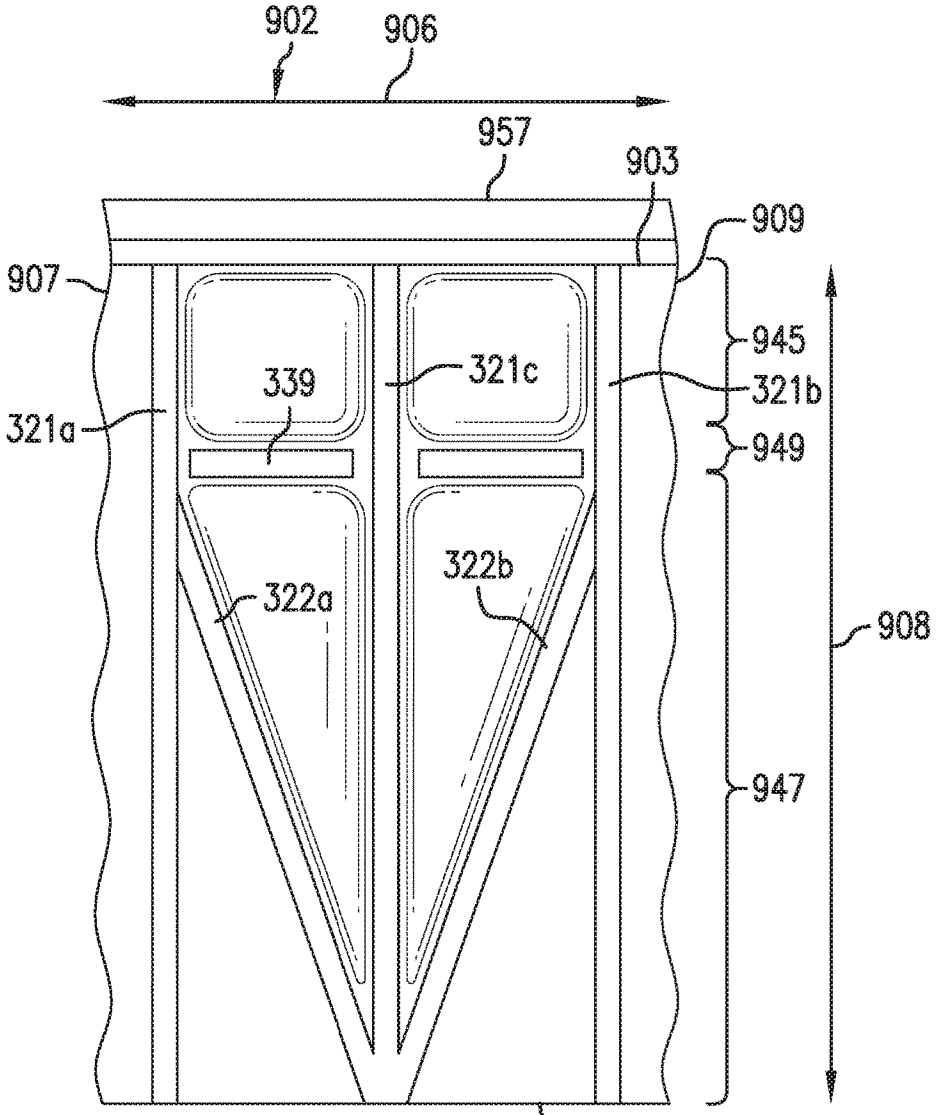

FIGS. 9A-B are top plan and side elevation views of an inflated insert 902 using an insert similar to the insert 301 of the uninflated structure 300 of FIG. 3. In some examples, the inflated insert may be folded or hinged in a lateral-medial direction, an anterior posterior direction, or a combination of both directions. In some examples, the seals between the plies form the hinge locations. The inflated insert 902 may be used as a shaped element in a shoe insert assembly. In some examples, the inflated insert may be folded upon itself.

The inflated insert 902 includes a lateral-medial direction 906, a medial edge 907 and a lateral edge 909, an anterior-posterior direction 908, an anterior end 955 (similar to the first longitudinal edge 317 of FIG. 3), and a posterior end 957 (similar to the second longitudinal edge 319 of FIG. 3). Different than FIG. 3, the inflation chambers 331 (FIG. 3) are inflated and sealed with a chamber seal 903 that extends between the medial edge 907 and the lateral edge 909. The medial edge 907 and lateral edge 909 are formed when the inflated insert 902 is separated along the lines of weakness 337 (FIG. 3).

Upon inflation of the inflation chamber, the seals 321, angled seals 322, and intermediate seals 339, together with the longitudinal chamber seal 903, form the boundaries and perimeters of different regions of the inflated insert 902. In the embodiment of FIG. 9A, a posterior region 945 has a length 965 extending in the anterior-posterior direction 908 that extends between the chamber seal 903 up to the edge of the intermediate seals 339 proximate the posterior end 957 of the insert 902. The posterior region 945 has a lateral-medial width that extends in the lateral-medial direction 906 between the seals 321*a* proximate the medial edge 907 and seal 321*b* proximate the lateral edge 909. In the embodiment of FIGS. 9A-B, the posterior region 945 is bisected by the seal 321*c*, allowing the insert 902 to be flexible in the lateral-medial direction 906 about the seal 321*c*.

An intermediate flexible region 949 has a length extending in the anterior-posterior direction 908 equal or greater to the width of the intermediate seals 339, and a lateral-medial width extending in the lateral-medial direction 906 between the seals 321*a* proximate the medial edge 907 and seal 321*b* lateral edge 909. In the embodiment of FIGS. 9A-B, the intermediate flexible region 949 is bisected by the seal 321*c*. The intermediate flexible region 949 allows for the insert 902 to be flexible in the anterior-posterior direction 908 and fold the posterior end 957 on top of the anterior end 955.

A front region 947 has a length 963 in the anterior-posterior direction 908 that extends from the edges of the intermediate seals 339 proximate the anterior end 955 of the insert 902 up to the anterior end 955. The front region 947 has a lateral-medial width in the lateral-medial direction 906 that extends between the seals 321*a* and 321*b*. The front region 947 is inflated in an area between the angled seals 322*a* and 322*b*, forming a tapered inflation region that may be similar to portions of a vamp of a shoe. The front region is bisected by the seal 321*c*. The seals allow the front region to be flexed and adjusted to shape to the vamp region of the shoe.

Figure 12C:
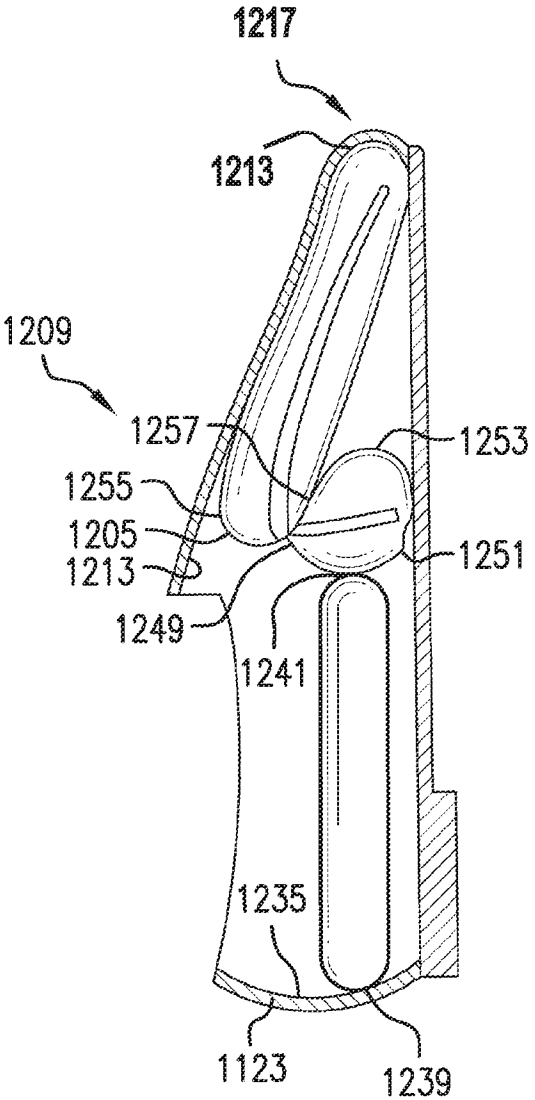
FIGS. 12A-C are the top plan, front cross-sectional, and side cross-sectional views of an additional embodiment of an inflated shoe insert assembly.
Figure 12B:
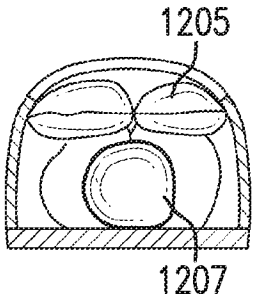
Figure 12A:
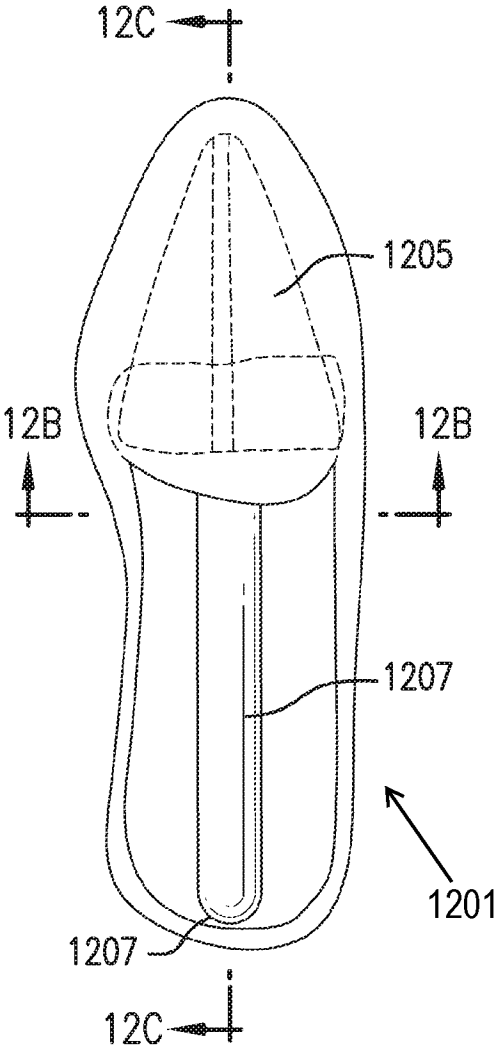

In some examples, the inflated insert 902 may have an inflated length, such as the combination of lengths of 963, 965 and the length of intermediate flexible region 949, that is shorter than the length of a shoe the insert 902 may be installed within (see FIGS. 12A-C). For examples, the inflated length may be in the range of 20 cm up to 30 cm, potentially used with shoes sizes in the range of US size 5-US size 14. The inflated length may be shorter so that the insert may be used in conjunction with shoes smaller than size 5. The inflated length may also be longer so that the insert may be used with shoes larger than size 14. The inflated length may also be longer so that the insert can be folded about itself to create a thicker insert while being used in a shoe.

In the embodiment of FIGS. 9A-B, excess web ply material 305, 311 extends between the seal 321*a* and the medial edge 907, the longitudinal chamber seal 903 and posterior end 957, and the seal 321*b* and lateral edge 909. The excess web ply material may also be removed. In embodiments of the flexible structure where the lines of weakness extend through the length of the seals 321*a* or 321*b*, there will not be excess individual web ply material surrounding a portion of the individual insert.

The seals 321*a*, 321*b*, 321*c*, angled seals 322*a*, 322*b*, and/or intermediate seals 339 may be used to increase the flexibility of the inflated insert 902. For example, the insert 902 may be folded, bent, or manipulated in the posterior-anterior direction 908 at the intermediate flexible region 949, as the inflated regions are filled with air or other gas and have a higher stiffness than the seal areas, which are made from the flexible web material which has a lower stiffness than the inflated areas. The insert 902 may be folded, bent or manipulated in the lateral-medial direction 906 about the seal 321*c*. The inflated regions are still flexible, as the pressure of the air or gas inside the inflated regions may be at or slightly above atmospheric pressure. The ability of to be flexibly manipulate the insert about the seals allows the insert to be used with a variety of shoe shapes and sizes. The inflation chamber can include a plurality of inflation chamber regions with a first hinge line that allows the chamber regions to be folded with respect to each other to fit within a shoe upper, and wherein the inflated and folded insert is tapered to fit within and support a shape of the shoe upper.

FIG. 9B is a right side elevation view of the inflated insert 902 of FIG. 9A. The front region 947 has a front region height 959. The posterior region 945 has a posterior region height 961. In some embodiments, the front region height 959 is similar to the posterior region height 961.

In some embodiments, the shape of the front region 947 is similar to the shape of a vamp region of a shoe, and is configured to flex and at least partially fill a toe cavity of the shoe. The insert 902 is configured such that when it is inserted into a shoe cavity, the insert 902 provides support to the front portion of a shoe, such as the vamp with the tongue and toe portion. The support provided by the insert 902 may prevent sagging or dropping of portions of the shoe into the shoe cavity.

In some embodiments, the lateral-medial width of the insert 902 may be larger than that of a shoe, so that the insert 902 flexes and bends to fit into the shoe cavity and provides support to the walls forming the vamp and quarter regions of the shoe.

While reference is made to the insert 902 inflations heights and lateral-medial widths, it should be understood that these components may be referred to as diameters of the insert 902. For example, in embodiments in which the insert 902 has a portion that is a column-like configuration, the inflation height and lateral-medial width may be substantially equal to each other. For example, cross-sections taken along the lateral-medial direction may be substantially circular, having a diameter.

In another example, the configuration of the insert 902 allows the insert 902 to also be used as an inflated packaging element placed within packaging with consumer or business products to protect the products during transportation.

Figure 10B:
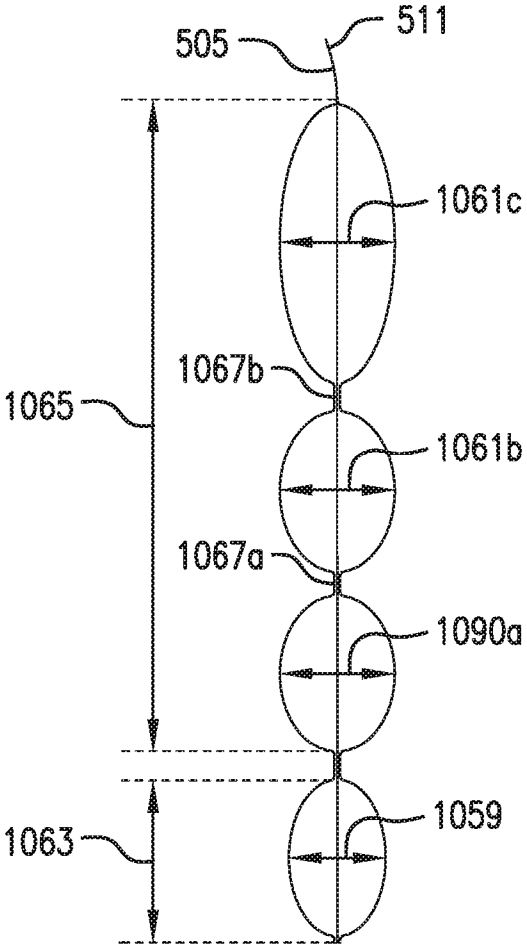
FIGS. 10A-B are top plan and side-elevation views of an inflated structure using the uninflated structure of FIG. 5.
Figure 10A:
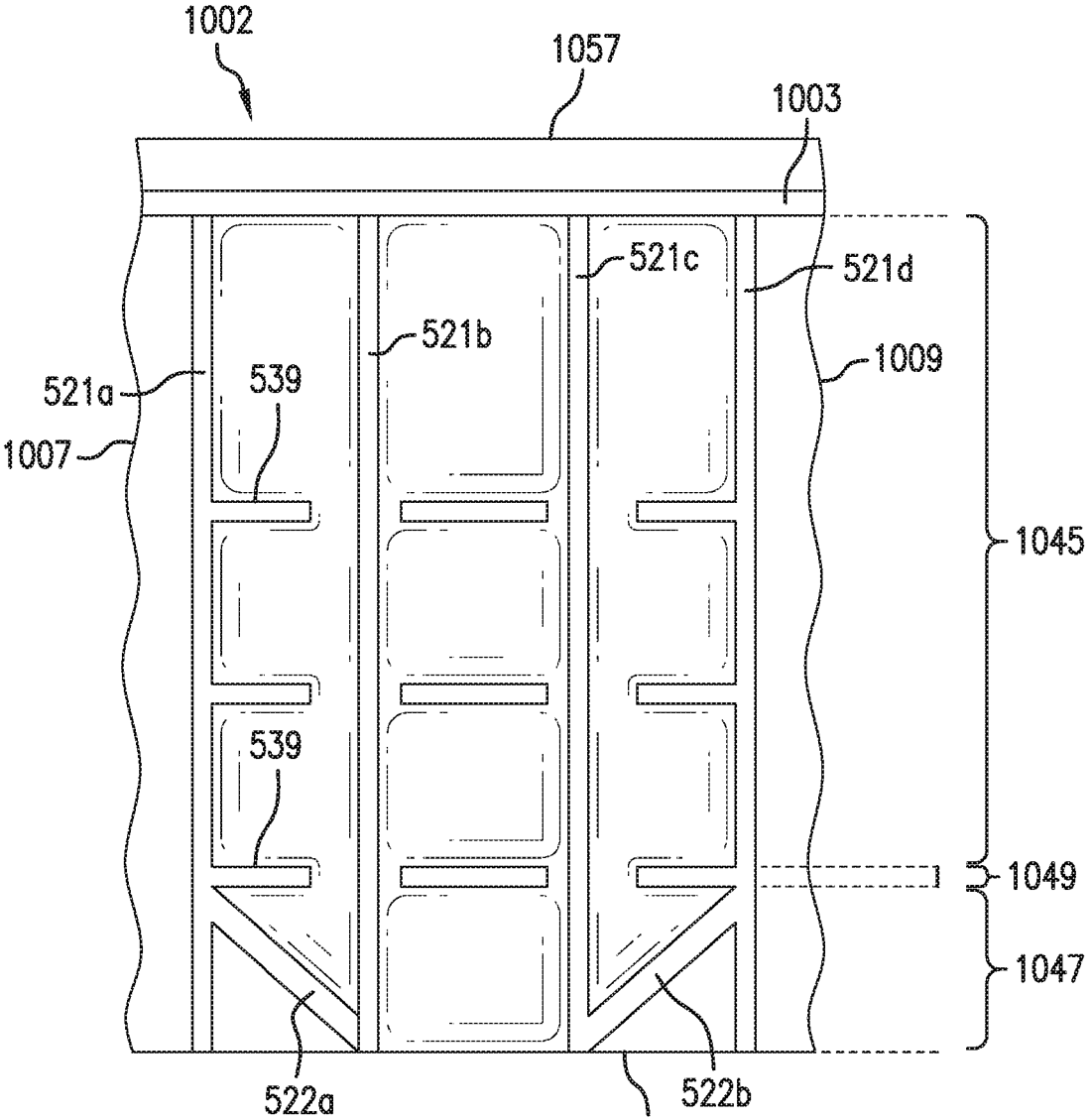

FIGS. 10A-B are top plan and side elevation views of an inflated insert 1002 using an uninflated insert similar to the uninflated insert 501 of FIG. 5 who inflation chambers are then inflated. The inflated insert 1002 of FIGS. 10A-10B is similar to the inflated insert 902 of FIGS. 9A-9B. The inflated insert 1002 includes a medial edge 1007, a lateral edge 1009, an anterior end 1055 (similar to the first longitudinal edge 517 of FIG. 5), and a posterior end (similar to the second longitudinal edge 519 of FIG. 5). Different than FIG. 5, the inflation chambers 531 (FIG. 5) are inflated and sealed with a chamber seal 1003 that extends between the medial edge 1007 and the lateral edge 1009. The medial edge 1007 and lateral edge 1009 are formed when the inflated insert 1002 is separated along the lines of weakness 537 (FIG. 5).

The insert 1002 has a posterior region 1045 with an anterior-posterior length 1065 that extends between the chamber seal 1003 and a posterior edge of intermediate seals 539 proximate the anterior end 1055. The posterior region 1045 has a lateral-medial width that extends between the seal 521*a* and the seal 521*d*, and the width is split by the seals 521*b* and 521*c*.

An intermediate flexible region 1049 has a length equal or greater to the width of the intermediate seals 539 proximate the anterior end 1055, and a lateral-medial width between the seal 521*a* and 521*d*. In the embodiment of FIGS. 10A-B, the intermediate flexible region 1049 is split by the seals 521*b* and 521*c*.

The insert 1002 has a front region 1047 with a length 1063 extending from the anterior edge of the intermediate seals 539 proximate the anterior end 1055 and extending to the anterior end 1055. The front region 1047 has a lateral medial width that extends from the seal 521*a* to the seal 521*d*, and is split by the seals 521*b*, 521*c*. The front region 1047 has an inflated portion formed by the anterior edge of the intermediate seals 539 proximate the anterior end 1055 and the lateral side edge of angled seals 522*a*, and the medial side edge of seal 522*b*. In some embodiments, the inflated portion of the front region 1047 may be conical or triangularly shaped.

As shown in FIG. 10B, the front region 1047 has a front region height 1059. The posterior region 1045 has posterior region heights 1061*a*, 1061*b*, and 1061*c*. In some embodiments, the posterior region heights 1061*a*, 1061*b*, 1061*c* are dissimilar. In some embodiments, the front region height 1059 is similar to the posterior region heights 1061*a*, 1061*b*, and 1061*c*.

The seals 521*a*, 521*b*, 521*c*, 521*d* form a pattern and may act as hinges and provide flexibility and allow the inflated insert 1002 to be bent, hinged, or manipulated in the lateral-medial direction. The angled seals 522*a*, 522*b* provide flexibility and allow the front region 1047 to be manipulated, shaped, or bent into a cone shape which may coincide to support the vamp of a shoe. The posterior region 1045 has additional flexible regions 1067*a*, 1067*b* based upon the location of the intermediate seals 539. The intermediate seals 539 provide additional flexibility and allow the insert 1002 to be bent, hinged, folded, or manipulated in the anterior-posterior direction. The seals 521, 522, 539 also help control the overall height of the various regions of the inflated insert. In an example, the seal pattern includes a second hinge extending generally in an anterior-posterior direction, such that first and second hinge lines divide lateral, center, and medial chamber regions. The first and second hinge lines are positioned so that the inflated and folded lateral and medial chamber regions are oriented upright with respect to the medial chamber region to increase the thickness of the shoe upper insert at lateral and medial sides thereof.

In another example, the configuration of the insert 1002 allows the insert 1002 to also be used as an inflated packaging element placed within packaging with consumer or business products to protect the products during transportation.

Figure 11C:
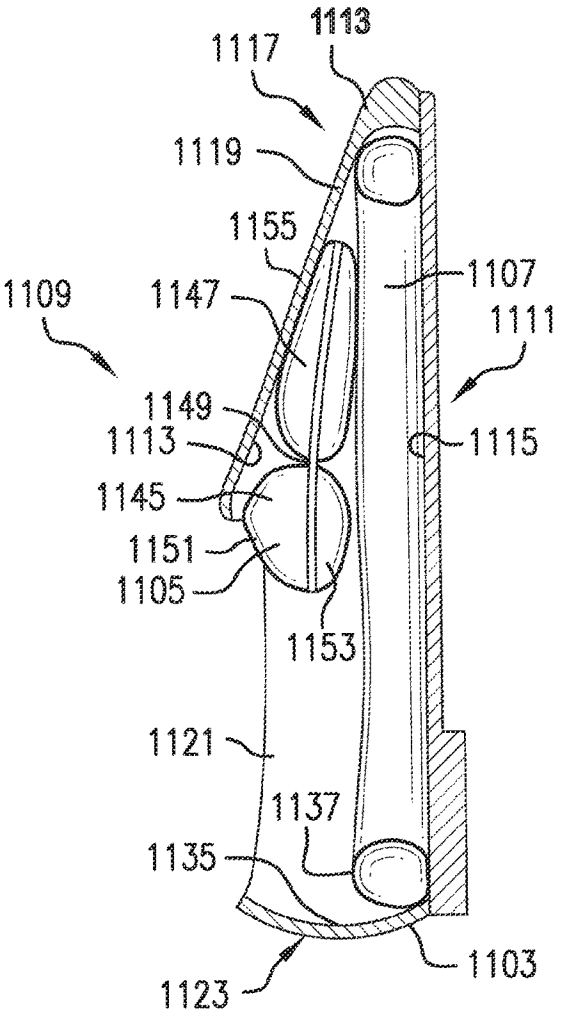
FIGS. 11A-C are top plan, front cross-sectional, and side cross-sectional views of an additional embodiment of an inflated shoe insert assembly.
Figure 11B:
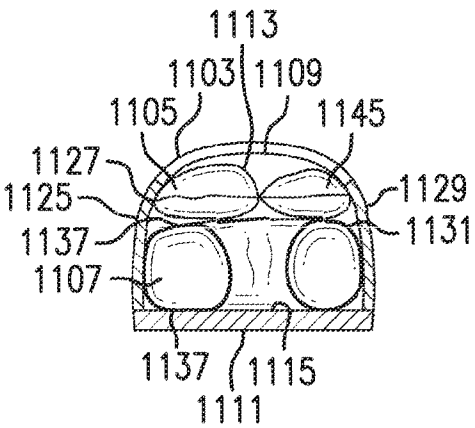
Figure 11A:
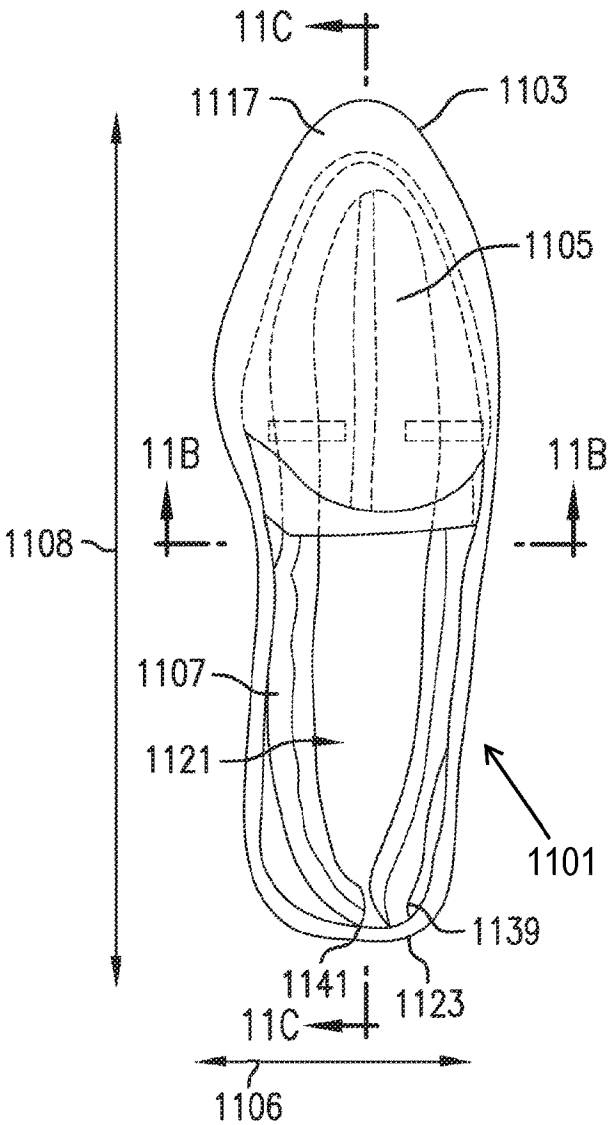

FIGS. 11A-C are the top plan, front cross-sectional, and side cross-sectional views of an additional embodiment of an inflated shoe insert assembly 1101 within a shoe. FIG. 11B is a front cross-sectional view of the inflated shoe insert assembly 1101 of FIG. 11A along line 11B-11B. FIG. 11C is a side cross-sectional view of the inflated shoe insert assembly 1101 of FIG. 11A along line 11C-11C. FIG. 11A shows a lateral-medial direction 1106 and an anterior-posterior direction 1108.

FIGS. 11A-C have a shoe 1103 with a with a vamp section having a toe 1117 with an inner surface 1133 and a tongue 1009 with an inner surface 1113; a quarter section having a rear quarter section 1123 with an inner surface 1135, a lateral side quarter section 1125 with an inner surface 1127, a medial side quarter section 1129 with an inner surface 1131; a sole 1111 with an inner surface 1115, and a cavity 1121 formed by the rear quarter section inner surface 1135, the medial side quarter section inner surface 1131, the lateral side quarter section inner surface 1127, the tongue inner surface 1113, the toe inner surface 1133, and the sole inner surface 1115. The inflated insert assembly 1101 may have multiple inflated elements including a shaped element 1105 and a tubular element 1107.

In some examples, the tubular element is configured to be positioned within the shoe cavity near the sole of the shoe and support a general inner circumference of the shoe, with the shaped element positioned above the tubular element and supporting a portion of the vamp of the shoe (see FIGS. 11A-11C). In some examples, the tubular element is positioned under the shaped element to overlap the shaped element along the anterior-posterior direction of the shoe in the installed position. In some examples, the tubular element is positioned between the inner surface of the rear quarter section of the shoe and the shaped element (see FIGS. 12A-12C). In some examples, the shaped element is not folded about a lateral-medial width (extending in the lateral-medial direction 1106) of the shaped element (see FIGS. 11A-11C) and in other examples the shaped element is folded about the lateral-medial width (see FIGS. 12A-14C). In some examples, the tubular element is not included and the shaped element is folded about its length and width to support the inside surface of the shoe (see FIGS. 15A-15C). In some examples, the tubular element is longer than the shoe, and the shaped element is configured to fit in an installed position with the tubular element bent such that the tubular element is doubled up under the shoe upper. In some examples, the tubular element and shaped element about each other, for example to increase the cumulative height or width compared to that of either element alone.

In the embodiment of FIGS. 11A-11C, the tubular element 1107 may be created by inflating an insert similar to the uninflated insert 101 of the flexible structure 100 of FIGS. 1 and 2. The tubular element 1107 may have a wing 1137 that extends from opposite sides of the generally circular cross-section, i.e. about 180 degrees apart (see FIG. 11B) that is created when the insert 101 is inflated and then separated along the lines of weakness 137. The tubular element 1107 may be installed within the cavity 1121 of the shoe 1103 so that the tubular element 1107 contacts the inner surface 1115 of the sole 1111. The tubular element 1107 may be generally folded or bent in half, so that a first end 1139 and a second end 1141 contact the inner surface 1135 of the rear quarter section 1123 (FIG. 11A). The middle section of the folded tubular element 1107 may then contact a portion of the vamp, such as the inner surface 1133 of the toe 1117 or the inner surface 1113 of the tongue 1009. The placement of the tubular element 1107 in this manner may provide support for the overall shape of the shoe 1103 and prevent it from collapsing or deforming. The placement of the tubular element 1107 with the wing 1137 facing generally vertical (as shown in FIG. 11B) may allow the tubular element to flex more into the shape of the shoe without collapsing or kinking upon itself.

In the embodiments of FIGS. 11A-11C, the shaped element 1105 may be similar to the inserts 301, 401 of FIGS. 3 and 4. The shaped element 1105 may have a posterior region 1145, a flexible region 1147, and an anterior region 1147. The posterior region 1145 has a first surface 1151 (formed from a portion of first film ply 305, 405 of FIGS. 3 and 4) positioned adjacent the inner surface 1113 of the tongue 1109, and a second surface 1153 (formed by a portion of second film ply 311, 411 of FIGS. 3 and 4) positioned adjacent to and contact a portion of the tubular element 1107. The second surface 1153 of the posterior region 1145 may also contact the wing 1137 of the tubular element 1107. The anterior region 1147 of the shaped element 1105 has a first surface 1155 (formed by a portion of first film ply 305, 405 of FIGS. 3 and 4) positioned adjacent the inner surface of the vamp, such as the inner surface 1113 of the tongue 1109 and also adjacent the inner surface 1133 of the toe 1117. The anterior region 1147 has a second surface 1157 (formed by a portion of second film ply 311, 411 of FIGS. 3 and 4) positioned adjacent and partially contacting the tubular element 1107. The second surface 1157 may also contact the wing 1137 of the tubular element 1107.

In some instances, the inflated insert assembly 1101 is configured to flex and fill the shoe cavity 1121, in order to maintain the structural form of the shoe 1103 during shipping and/or storing. The inflated insert assembly 1101 can flexibly form to the shoe 1103 to fill out the various widths and shapes of the vamp and provide stiffness through the length of the sole 1111 and to the rear quarter section 1123 to maintain a flat and formed shoe.

As shown in FIG. 11B, in some embodiments, the tubular element 1107 is adjacent to and contacts the inner surface 1127 of the lateral side 1125 as well as the inner surface 1331 of the medial side 1129. The shaped element 1105 may also contact the inner surfaces 1127 and 1131.

FIGS. 12A-12C are a top plan, front cross-sectional, and side cross-sectional views of an additional embodiment of an inflated shoe insert assembly 1201. FIG. 12B is a front cross-sectional view of the inflated shoe assembly 1201 of FIG. 12A along line 12B-12B. FIG. 12C is a side cross-sectional view of the inflated shoe insert assembly 1201 of FIG. 12A along line 12C-12C. The inflated insert assembly 1201 is similar to the inflated insert assembly 1101 of FIGS. 11A-11C. Differences between the inflated insert assembly 1201 and the inflated insert assembly 1101 are the relative size and position of a tubular element 1207 and how it positioned adjacent a shaped element 1205.

In the embodiment of FIGS. 12A-12C, the shaped element 1205 may be folded or bent at a flexible region 1249, so that the shaped element 1205 is folded upon itself. The element may be folded about itself in an anterior-posterior direction, in a lateral-medial direction, or in a combination of the directions. The shaped element may be folded and installed within a shoe by itself or in combination with another inflated element to support the shoe upper. In some examples, the seal pattern of the shaped element has separate inflatable chambers that are sealed from each other.

For example, in FIGS. 12A-C, the anterior region is positioned above the posterior region 1245. For example, a second surface 1253 of the posterior region 1245 may contact a portion of a second surface of a front region 1247. A first surface 1255 of the front region may be positioned adjacent to and contact an inner surface of the vamp, such as the inner surface 1213 of a tongue 1209 and an inner surface 1233 of a toe 1217. Portions of the first and second surfaces 1251, 1253 of the posterior region may contact an inner surface 1215 of the sole 1211. The folded positon of the shaped element 1205 about the seals allows the height and or thickness of the shaped element and insert unit 1202 to be manipulated to better support various aspects of the shoe, such as the vamp region. In other embodiments, the element 1205 may be bent in a manner opposite that shown in FIGS. 12A-12C, such that the first surface 1255 of the front region may contact the first surface 1249 of the rear region, the a majority of the second surface 1257 may be positioned adjacent to and contact the inner surface 1215 of the sole, and the second surface 1253 is adjacent to and contacting the inner surface 1213 of the tongue 1209.

As shown in FIGS. 12A and 12C, a first end 1239 of the tubular element 1207 may contact an inner surface 1235 of a rear quarter section 1123. A second end of 1241 of the tubular element 1207 may contact a first surface 1251 of the posterior region 1245 of the shaped element 1205.

Figure 13C:
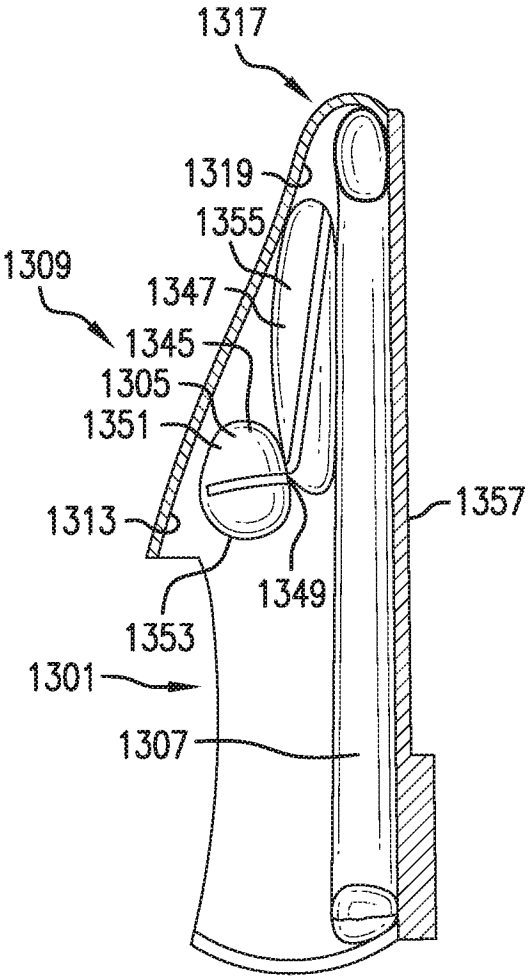
FIGS. 13A-C are the top plan, front cross-sectional, and side cross-sectional views of an additional embodiment of an inflated shoe insert assembly.
Figure 13B:
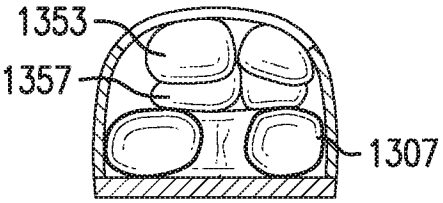
Figure 13A:
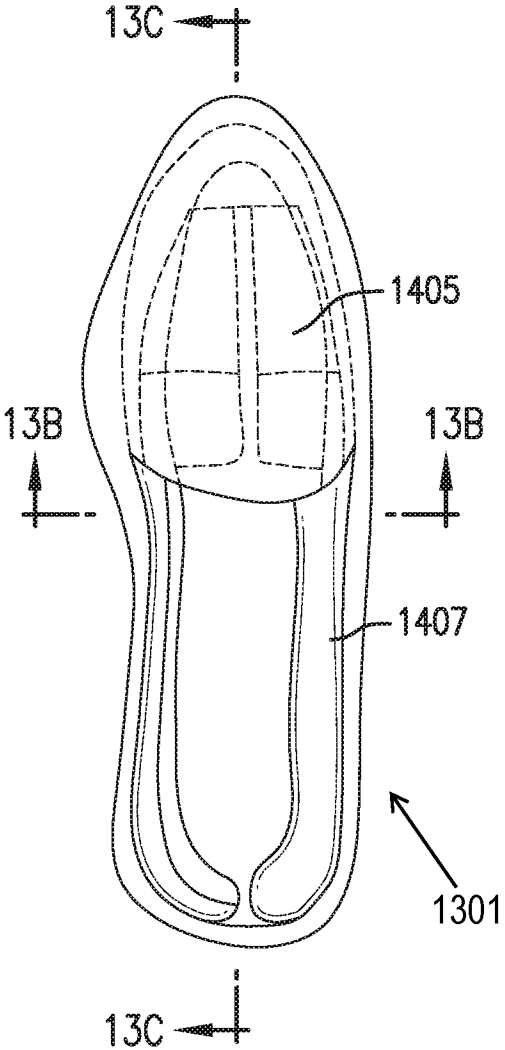

FIGS. 13A-C are a top plan, front cross-sectional, and side cross-sectional views of an additional embodiment of an inflated shoe insert assembly 1301. FIG. 13B is a front cross-sectional view of the inflated shoe insert assembly 1301 of FIG. 13A along line 13B-13B. FIG. 13C is a side cross-sectional view of the inflated shoe insert assembly 1301 of FIG. 13A along line 13C-13C. The inflated insert assembly 1301 is similar to the inflated assembly 1101 of FIGS. 11A-11C. Differences between the inflated assembly 1301 and the inflated assembly 1101 are the position of a shaped element 1305 with a tubular element 1307. The shaped element 1305 may be folded, bent or otherwise manipulated at a flexible region 1349 so that the anterior region 1347 is positioned below the posterior region 1345. For example, a first surface 1351 of the posterior region 1345 is positioned adjacent to and contacting a first surface 1355 of the anterior region 1347. The first surface 1355 of the front region 1347 may contact and support an inner surface 1319 of a toe 1317. Both the first and second surfaces 1351, 1353 of the posterior region 1345 may contact an inner surface 1313 of a tongue 1309. A second surface 1357 of the anterior region 1347 may be positioned adjacent the tubular element 1307.

Figure 14A:
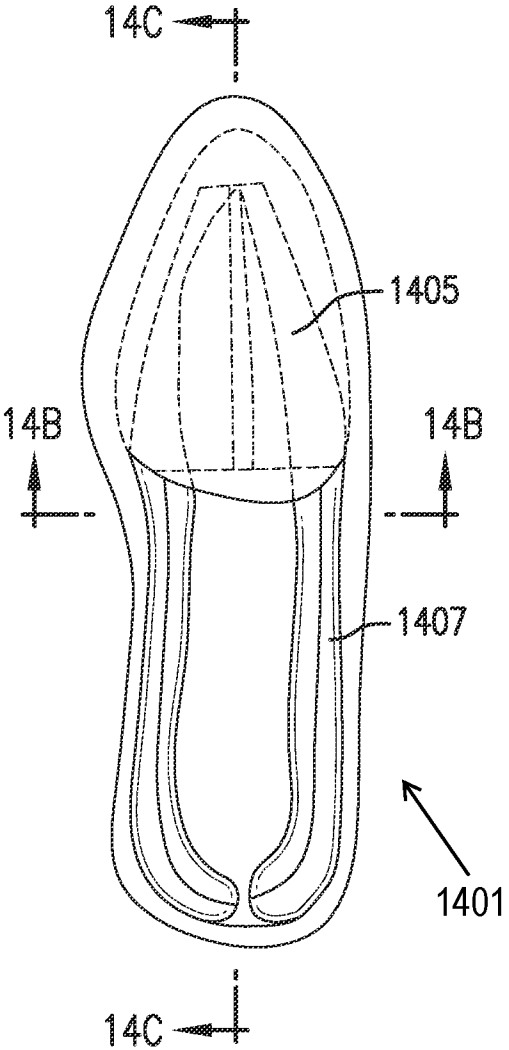
FIGS. 14A-C are the top plan, front cross-sectional, and side cross-sectional views of an additional embodiment of an inflated shoe insert assembly.
Figure 14B:
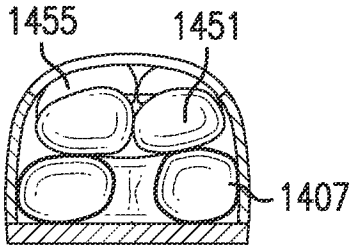
Figure 14C:
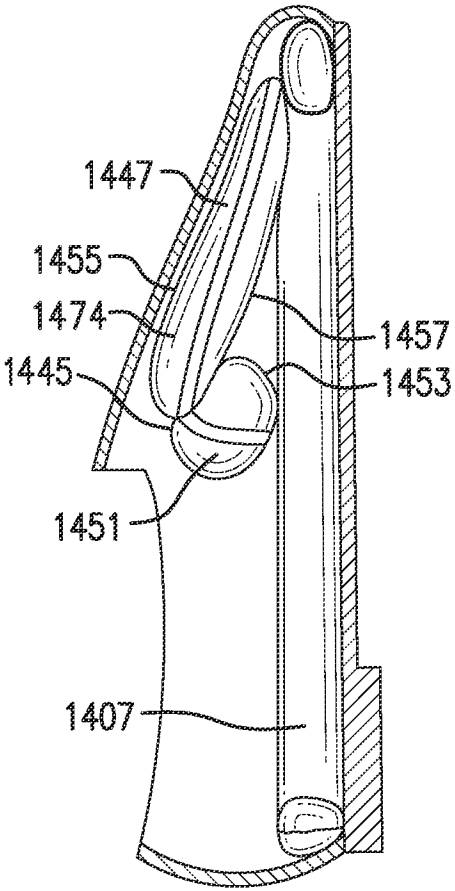

FIGS. 14A-C are a top plan, front cross-sectional, and side cross-sectional views of an additional embodiment of an inflated shoe insert assembly 1401. FIG. 14B is a front cross-sectional view of the inflated shoe insert assembly 1401 of FIG. 14A along line 14B-14B. FIG. 14C is a side cross-sectional view of the inflated shoe insert assembly 1401 of FIG. 14A along line 14C-14C. The inflated insert assembly 1401 is similar to the inflated insert assembly 1301 of FIGS. 13A-13C. Differences between the inflated insert assembly 1401 and the inflated insert assembly 1301 are the position of a shaped element 1405 with a tubular element 1407. The shaped element 1405 may be folded opposite that of the position of the shaped element 1305 in FIGS. 13A-13C, such that the anterior region 1474 is positioned above the posterior region 1445. For example, a second surface 1453 of a posterior region 1445 is adjacent to and contacts a second surface 1457 of a front region 1447. A first surface 1455 of the front region 1447 may be adjacent to, contact, or support both an inner surface 1313 of a tongue 1309 and an inner surface 1319 of a toe 1317. A first surface 1451 and the second surface 1453 of the posterior region 1445 may contact the tubular element 1407.

Figure 15C:
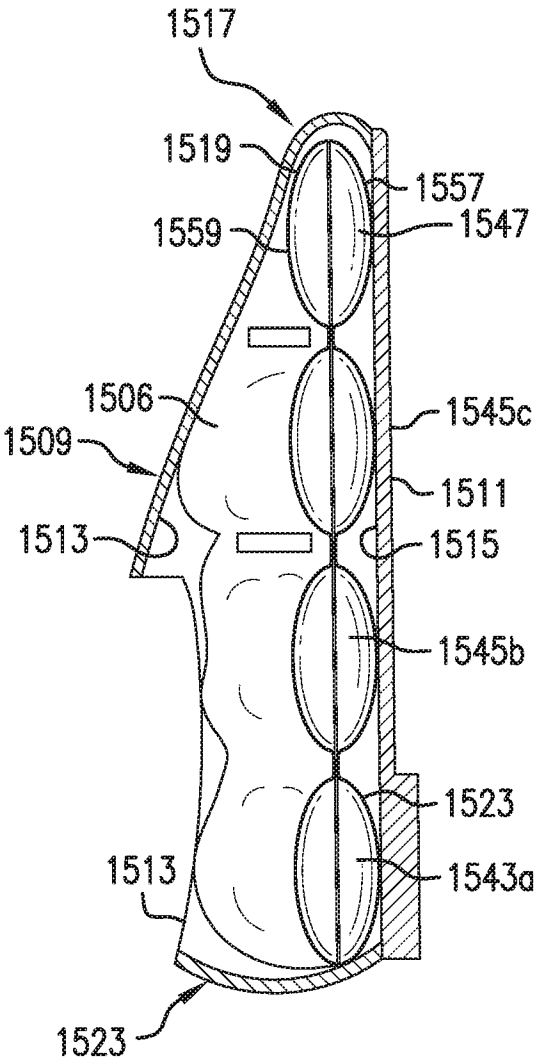
FIGS. 15A-C are the top plan, front cross-sectional, and side cross-sectional views of an additional embodiment of an inflated shoe insert assembly.
Figure 15B:
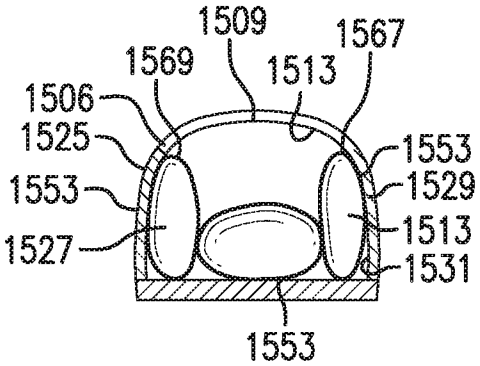
Figure 15A:
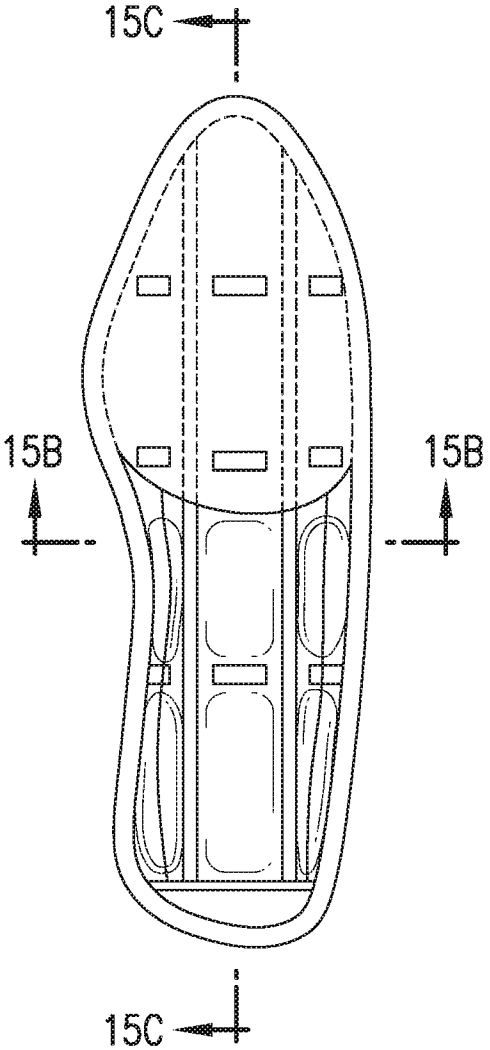

FIGS. 15A-C are a top plan, front cross-sectional, and side cross-sectional views of an additional embodiment of an inflated shoe insert assembly 1501. FIG. 15B is a front cross-sectional view of the inflated shoe insert assembly

1501 of FIG. 15A along line 15B-15B. FIG. 15C is a side cross-sectional view of the inflated shoe assembly 1501 of FIG. 15A along line 15C-15C. The inflated insert assembly 1501 is similar to the inflated insert assembly 1101 of FIGS. 11A-11C. A difference between the inflated insert assembly 1501 and the inflated insert assembly 1101 is that there is a single shaped element 1506. The element 1506 may be similar to the insert 1002 of FIGS. 10A-10B, uninflated insert 701 of FIG. 7, uninflated insert 601 of FIG. 6, and uninflated insert 501 of FIG. 1. The element 1506 may have a tapered region 1547 to support the vamp area including the toe 1517 and tongue 1509 of the shoe. The element 1506 may have inflated regions 1545*a*, 1545*b*, 1545*c* to support the vamp area, such as the tongue 1509 and other areas of the shoe 1503, including the rear quarter section 1523. Inflated regions 1545*a*, 1545*b*, 1545*c* may have a second surface 1553 that contacts or is adjacent to an inner surface 1515 of a sole 1511, an inner surface 1527 of a lateral side 1525 (forming an upright wall hinged at the seal extending in the anterior-posterior direction), and an inner surface 1531 of medial side 1529 (forming another upright wall extending in the anterior-posterior direction). A lateral edge 1569 and a medial edge 1567 may contact the inner surface 1513 of the tongue 1509.

While some of the various inserts described herein have been described with respect to being positioned with a single shoe or a pair of shoes or to protect a single shoe or a pair of shoes, the individual inserts as described herein could be used as an individual inflated packaging elements or a combination of inflated packaging elements to protect various products during shipment.

In accordance with various embodiments, these components and other components which may be utilized within an inflation and sealing device including without limitation, the nozzle, blower sealing assembly, and drive mechanisms, and their various components or related systems may be structured, positioned, and operated as disclosed in any of the various embodiments described in the incorporated references such as, for example, U.S. Pat. Nos. 8,061,110; 8,128,770; U.S. Patent Publication No. 2014/0261752; U.S. Patent Publication No. 2011/0172072; and U.S. Patent Publication No. 2017/0071292 each of which is herein incorporated by reference. Also, the various systems, materials, processes, and components described in U.S. Pat. No. 7,926,507 may be used, which is hereby incorporated by reference in its entirety. Also, the webs described herein may be formed as disclosed in U.S. Application Publication No. 2015/0033669, which is hereby incorporated by reference in its entirety. Each of the embodiments discussed herein may be incorporated and used with the various sealing devices of the incorporated references and/or other inflation and sealing devices. For example, any mechanism discussed herein or in the incorporated references may be used in the inflation and sealing of web as the web or film material described in the incorporated references.

What is claimed is:

1. An inflatable shoe and insert assembly, comprising:

a shoe having a shoe upper; and an inflatable shoe insert assembly, comprising:

a tubular element formed of opposing, flexible, polymeric plies that are sealed together along a seal pattern that defines a tubular element inflation chamber configured to seal inflation fluid therein, wherein the tubular element inflation chamber has a tubular shape; and a shaped element formed of opposing, flexible, polymeric plies that are sealed together along a seal pattern that defines a shaped element inflation chamber configured to seal inflation fluid therein;

wherein the shaped element and tubular element are configured and dimensioned to fit together within the shoe upper and support each other in an installed position to cooperatively support and maintain a shape of the shoe upper, wherein the tubular element extends in the installed position, from within the shoe upper to a shoe heel of the shoe along an anterior-posterior direction of the shoe.

2. The assembly of claim 1, wherein tea length of the tubular element is greater than a length of the shaped element, and wherein a width of the shaped element is greater than a width of the tubular element, enabling the shaped element to overlap the tubular element in the installed position.

3. The assembly of claim 1, wherein the tubular element is longer than the shoe and the shaped element is configured to fit in the installed position with the tubular element bent such that the tubular element is doubled up under the shaped element.

4. The assembly of claim 1, wherein the seal pattern of the shaped element defines a plurality of separate inflatable chambers that are sealed from each other.

5. The assembly of claim 4, wherein the shaped element seal pattern defines a hinge line in the shaped element to facilitate bending the shaped element in the installed position.

6. The assembly of claim 1, wherein the seal pattern of the shaped element provides the shaped element with a tapered profile when inflated.

7. The assembly of claim 1, wherein seal pattern of the tubular element and the seal pattern of the shaped element provide the tubular element and the shaped element with inflated configurations that fit together within the shoe and support each other in an installed position in the shoe, cooperatively supporting and maintaining a shape of an upper portion of the shoe.

8. The assembly of claim 1, wherein the inflation chambers are inflated and sealed, and wherein the tubular element and shaped element are received in an installed position within the shoe in which the tubular element and the shaped element support each other and cooperatively support and maintain a shape of the shoe upper.

9. The assembly of claim 1, wherein the inflatable shoe insert assembly further comprises an anterior-posterior hinge line formed in an anterior-posterior direction.

10. The assembly of claim 9, wherein the inflatable shoe insert assembly is configured to bend in a lateral-medial direction about the anterior-posterior hinge line to increase a thickness of the shoe insert assembly.

11. The assembly of claim 1, wherein the inflatable shoe insert assembly further comprises angled hinge lines with respect to an anterior-posterior direction and lateral-medial direction.

12. The assembly of claim 9, wherein the inflatable shoe insert assembly is configured to bend at the angled hinge lines to support the shoe upper in the installed position.

13. The assembly of claim 1, wherein the shaped element further comprises lateral-medial hinge lines formed in a lateral-medial direction.

14. The assembly of claim 13, wherein the shaped element is configured to bend in an anterior-posterior direction at the lateral-medial hinge lines to increase a thickness of the shoe insert assembly.

15. The assembly of claim 1, wherein the shoe upper has a vamp region with a tapered shape in a lateral-medial direction, and the shaped element further comprises a tapered shape configured to support the tapered shape of the vamp region.

16. An inflatable shoe upper insert, comprising:

a shoe having a shoe upper; and opposing, flexible, polymeric plies that are sealed together along a seal pattern that defines:

a plurality of inflation chambers configured to seal an inflation fluid therein, the one or more inflation chambers including a plurality of inflation chamber regions, and a first hinge line that allows the chamber regions to be folded with respect to each other to fit within the shoe upper;

wherein the inflated and folded insert is tapered to fit within the shoe upper, and wherein the plurality of inflation chambers includes a first inflation chamber and a second inflation chamber configured and dimensioned to fit together with the first inflation chamber being positioned below the second inflation chamber.

17. The inflatable shoe upper insert of claim 16, wherein the first hinge line extends generally in an anterior-posterior direction with respect the tapered shape to fit in the shoe upper.

18. The inflatable shoe upper insert of claim 16, wherein the seal pattern includes a second hinge extending generally in an anterior-posterior direction, such that first and second hinge lines divide lateral, center, and medial chamber regions.

19. The inflatable shoe upper insert of claim 16, wherein first and second hinge lines are positioned so that the inflated and folded lateral and medial chamber regions are oriented upright with respect to the medial chamber region to increase the thickness of the shoe upper insert at lateral and medial sides thereof.

20. The inflatable shoe upper insert of claim 16, wherein hinge line extends generally in a lateral-medial direction with respect the tapered shape to fit in the shoe upper.

21. The inflatable shoe upper insert of claim 16, wherein the taper of the insert is configured to fit in and support a tapered shape of a vamp region of the shoe upper.

* * * * *